US011135524B2

(12) United States Patent
Klenk

(10) Patent No.: US 11,135,524 B2
(45) Date of Patent: Oct. 5, 2021

(54) EXCAVATOR SHOVEL ASSEMBLY

(71) Applicant: Bruder Spielwaren GmbH + Co. KG, Fürth (DE)

(72) Inventor: Rainer Klenk, Langenzenn (DE)

(73) Assignee: Bruder Spielwaren GmbH + Co. KG, Fürth (DE)

( * ) Notice: Subject to any disclaimer, the term of this patent is extended or adjusted under 35 U.S.C. 154(b) by 0 days.

(21) Appl. No.: 16/752,927

(22) Filed: Jan. 27, 2020

(65) Prior Publication Data

US 2020/0238187 A1 Jul. 30, 2020

(30) Foreign Application Priority Data

Jan. 28, 2019 (DE) ..... 10 2019 201 054.7

(51) Int. Cl.
*A63H 17/12* (2006.01)

(52) U.S. Cl.
CPC ..... *A63H 17/12* (2013.01)

(58) Field of Classification Search
CPC ..... A63H 17/12
USPC ..... 446/424, 425, 426, 427, 428
See application file for complete search history.

(56) References Cited

U.S. PATENT DOCUMENTS 2,563,974 A * 8/1951 Thierry ..... A63H 17/12 446/425
2,812,869 A * 11/1957 Nisperly ..... A63H 17/12 414/726
2,896,802 A * 7/1959 Norris ..... A63H 33/3044 414/694
2,985,983 A * 5/1961 Konstenius ..... A63H 17/12 446/426
3,161,987 A * 12/1964 Decker ..... A63H 17/12 446/425
3,462,874 A * 8/1969 Pauly ..... A63H 17/12 446/425
3,539,063 A * 11/1970 Masura ..... A63H 17/12 414/694
3,624,957 A * 12/1971 Good ..... A63H 17/12 446/425

(Continued)

FOREIGN PATENT DOCUMENTS

DE 29800336 U1 3/1998
DE 202005001824 U1 5/2005

(Continued)

*Primary Examiner* — Joseph B Baldori
(74) *Attorney, Agent, or Firm* — Smartpat PLC

(57) ABSTRACT

An excavator shovel assembly has an excavator shovel and a shovel arm. A shovel swivel locking device locks the excavator shovel relative to the shovel arm. It has a shovel connecting lever, a shovel arm connecting lever and a rocker connecting lever. The shovel connecting lever is connected to the excavator shovel via a shovel connecting joint. The shovel arm connecting lever is connected to the shovel arm via a shovel arm connecting joint. The rocker connecting lever is connected to the shovel connecting lever via a shovel rocker connecting joint and to the shovel arm connecting lever via a shovel arm rocker connecting joint. The shovel connecting joint and the rocker connecting joints are arranged such that the rocker connecting lever is displaceable between a shovel lifting position and a shovel delivery position through a dead center position, defined by the shovel connecting joint and a rocker connecting joint.

8 Claims, 30 Drawing Sheets

(56) References Cited

U.S. PATENT DOCUMENTS

| | | | | | |
|---|---|---|---|---|---|
| 3,744,181 | A * | 7/1973 | Gagnon | A63H 17/12 | 446/425 |
| 4,712,968 | A * | 12/1987 | Manning | A63H 17/12 | 180/329 |
| 6,508,320 | B2 * | 1/2003 | Huntsberger | B62K 9/00 | 180/65.1 |
| 7,347,763 | B2 * | 3/2008 | Ewringmann | A63H 17/12 | 446/427 |
| 7,976,356 | B2 * | 7/2011 | Bruder | A63H 17/12 | 446/434 |
| 9,643,098 | B2 * | 5/2017 | Schneider | A63H 17/14 | |
| 2008/0207086 | A1 * | 8/2008 | Ewringmann | A63H 17/12 | 446/428 |

FOREIGN PATENT DOCUMENTS

| | | | |
|---|---|---|---|
| EP | 1121965 | B1 | 9/2004 |
| EP | 1693093 | B1 | 3/2008 |
| EP | 3047887 | B1 | 7/2018 |

* cited by examiner

EXCAVATOR SHOVEL ASSEMBLY

TECHNICAL FIELD

The disclosure relates to an excavator shovel assembly with an excavator shovel and a shovel arm connected to it by a shovel swivel joint. In addition, the disclosure relates to an excavator structure for a toy with such an excavator shovel assembly and a toy with such an excavator structure.

BACKGROUND

Toys with excavator structures are known, for example, from EP1121965B1, EP1693093B1 and EP3047887B1.

SUMMARY

It is an object of the present invention to fix different basic positions of an excavator shovel safely, but at the same time in a manner that is easily changeable, in order to elevate the playing experience.

This object is achieved by an excavator shovel assembly having an excavator shovel. A shovel arm is connected via a shovel swivel joint to the excavator shovel. A shovel swivel locking device locks the excavator shovel relative to the shovel arm. The shovel swivel locking device includes a shovel connecting lever that is connected to the excavator shovel via a shovel connecting joint. It further includes a shovel arm connecting lever that is connected to the shovel arm via a shovel arm connecting joint. It also includes a rocker connecting lever that is connected, at one end, to the shovel connecting lever via a shovel rocker connecting joint and, at an opposite end, to the shovel arm connecting lever via a shovel arm rocker connecting joint.

The shovel connecting joint and the two rocker connecting joints are arranged in such a manner that the rocker connecting lever is displaceable between a shovel lifting position, in which the excavator shovel is in a raised lifting swivel position relative to the shovel arm, and a shovel delivery position, in which the excavator shovel lies relative to the shovel arm in a delivery swivel position pivoted downwards in comparison with the shovel lifting position. To switch between the two position the rocket connecting lever moves through a dead center position in which one of the two shovel arm rocker connecting joints passes through a dead center joint plane which is defined by the shovel connecting joint and the other of the two rocker connecting joints.

A shovel swivel locking device with a rocker connecting lever, which can overcome a dead center position, represents a configuration that is sufficiently safe and sufficiently easy to overcome for the specification of different basic positions of the excavator shovel relative to the shovel arm.

The delivery swivel position of the excavator shovel can be achieved after overcoming the dead center of the rocker connecting lever under a dead weight of the excavator shovel.

An operating handle that is attached to the shovel connecting lever facilitates handling of the shovel swivel locking device. The operating handle can be integrally formed on the shovel connecting lever, in particular in one piece. The operating handle can be arranged in such a manner that one-hand operation of the shovel swivel locking device is possible. The operating handle may be arranged in such a manner that it can be operated in the same manner by both right-handed and left-handed persons.

A configuration in which the operating handle is configured to exert tensile and compressive forces on the shovel connecting lever facilitates the operation of the shovel swivel locking device.

An excavator structure for a toy comprises the excavator shovel assembly, a frame component, and an actuating component that is guided in a displaceable manner relative to the shovel arm between a locking position, in which a locking element connected to the frame component interacts with a stop of the shovel arm to hold the shovel arm in a shovel arm lifting position and a release position in which the actuating component displaces the locking element such that it comes out of engagement with the stop of the shovel arm, such that the shovel arm is displaceable into a shovel arm lowering position. The advantages of such an excavator structure are the same as those explained above with reference to the excavator shovel assembly. The shovel arm lowering position can be achieved under a dead weight of the shovel arm after the changeover of the actuating component to the release position. The actuating component can be designed as an actuating knob.

The actuating component may be pretensioned in the locking position. A preload of the actuating component ensures a safe and reproducible positioning of the actuating component. The preload can be applied via a spring component, which is attached to the shovel arm, for example, and which can in particular be an integral or one-piece component of the shovel arm.

The locking element may be connected to the frame component via a locking connecting joint. A hinge connection between the locking element and the frame component results in an approximation of the kinematics of the excavator structure when the shovel arm moves to a real excavator model.

The advantages of a toy with the described excavator structure are the same as those explained above in connection with the excavator structure and excavator shovel. The toy may be a toy vehicle. In particular, the toy may be made entirely of plastic. Some or all of the components of the toy may be injection molded parts.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1:
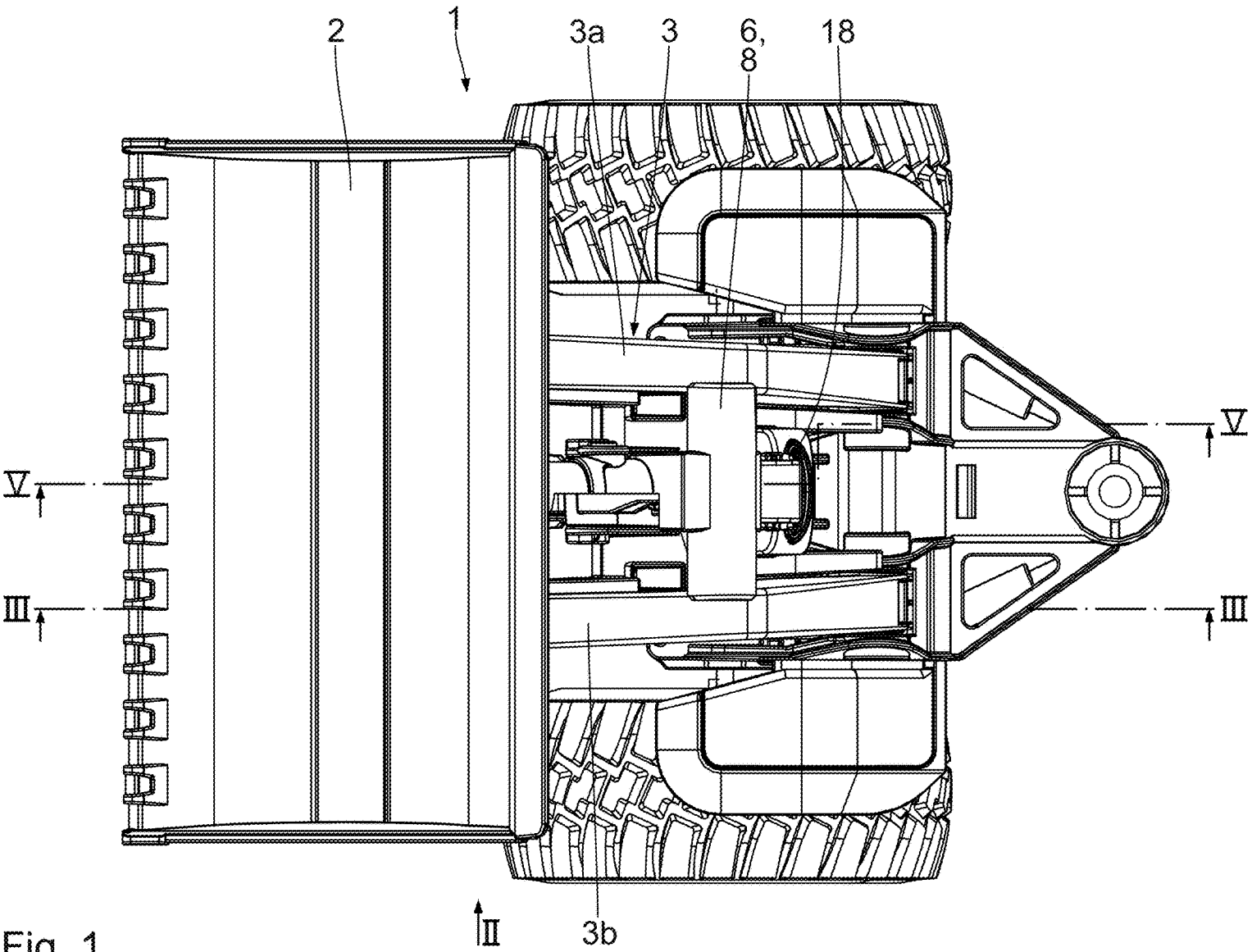
FIG. 1 is a view of a front section of an excavator toy vehicle with an excavator structure comprising an excavator shovel assembly, wherein an excavator shovel of the assembly is in a shovel lifting position and a shovel arm of the assembly is in a shovel arm lifting position.
Figure 2:
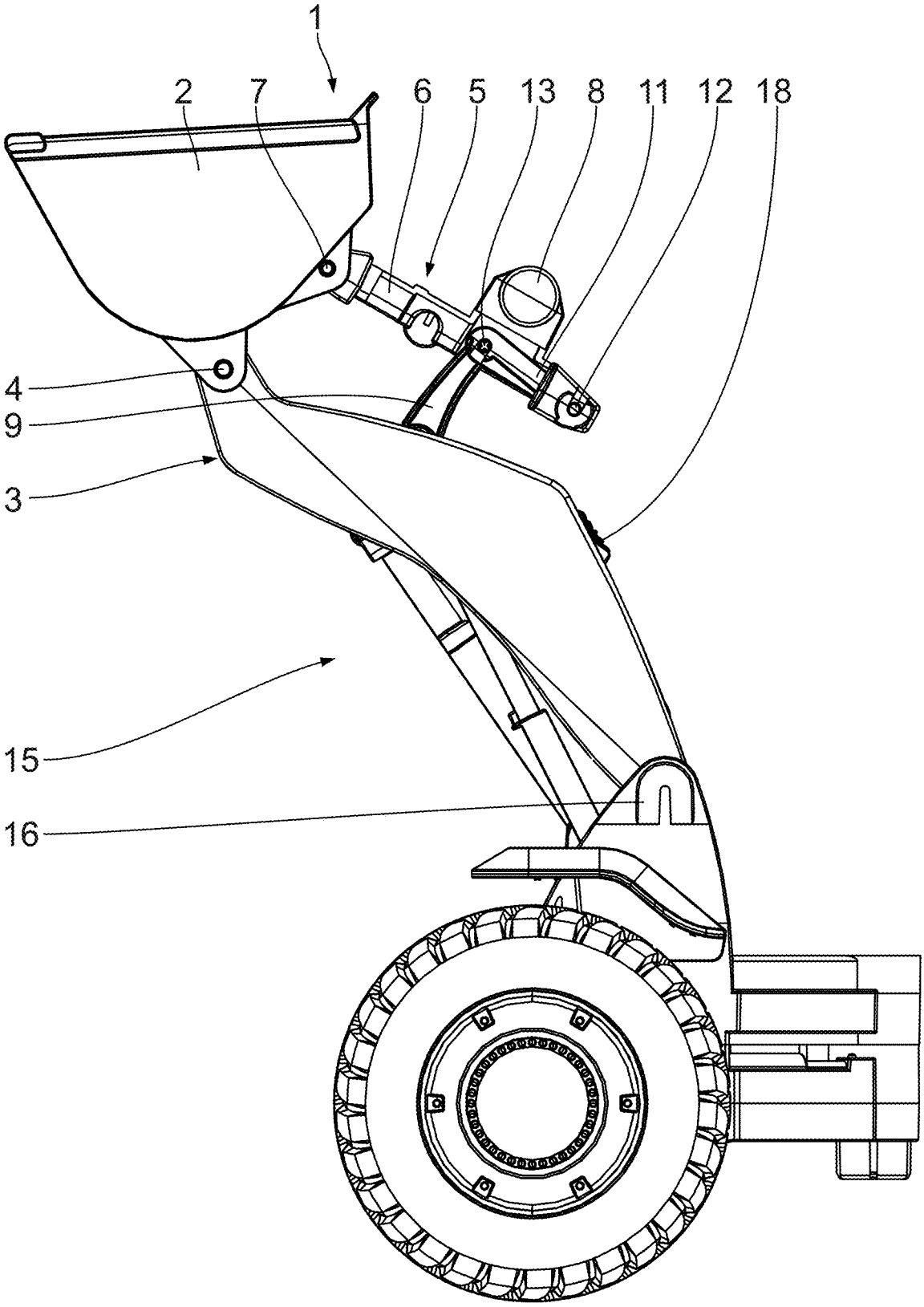
FIG. 2 is a side view of the vehicle section according to FIG. 1, seen from view direction II in FIG. 1.

An excavator shovel assembly 1 is shown in FIGS. 1 to 8 with an excavator shovel 2 in a shovel lifting position and a shovel arm 3 in a shovel arm lifting position. The excavator shovel 2 is connected to the shovel arm 3 via a shovel swivel joint with joint axis 4. The joint axis 4 runs horizontally. As shown (for example) in FIG. 1, the shovel arm 3 is designed to be double-armed with two partial arms, which are marked with 3*a*, 3*b* in FIG. 1.

A shovel swivel locking device 5 is used to lock or fix the position of the excavator shovel 2 relative to the shovel arm 3. Such device has a shovel connecting lever 6, which is connected to the excavator shovel 2 via a shovel connecting joint with joint axis 7. An operating handle 8 for the excavator shovel assembly 1 is attached to the shovel connecting lever 6. The operating handle 8 is integrally formed in one piece on the shovel connecting lever 6. The operating handle 8 is designed in such a manner that both tensile and compressive forces can be exerted on the shovel connecting lever 6.

Furthermore, the shovel swivel locking device 5 has a shovel arm connecting lever 9. The latter is connected to the shovel arm 3 via a shovel arm connecting joint with a joint axis 10 (see FIG. 7).

A rocker connecting lever 11 also belongs to the shovel swivel locking device 5. The rocker connecting lever 11 is connected, at one end, to the shovel connecting lever 6 via a shovel rocker connecting joint with joint axis 12 and, at an opposite end, to the shovel arm connecting lever 9 via a shovel arm rocker connecting joint with joint axis 13.

The joint axes 7, 12 and 13 are arranged parallel to one another and at a distance from one another.

Figure 12:
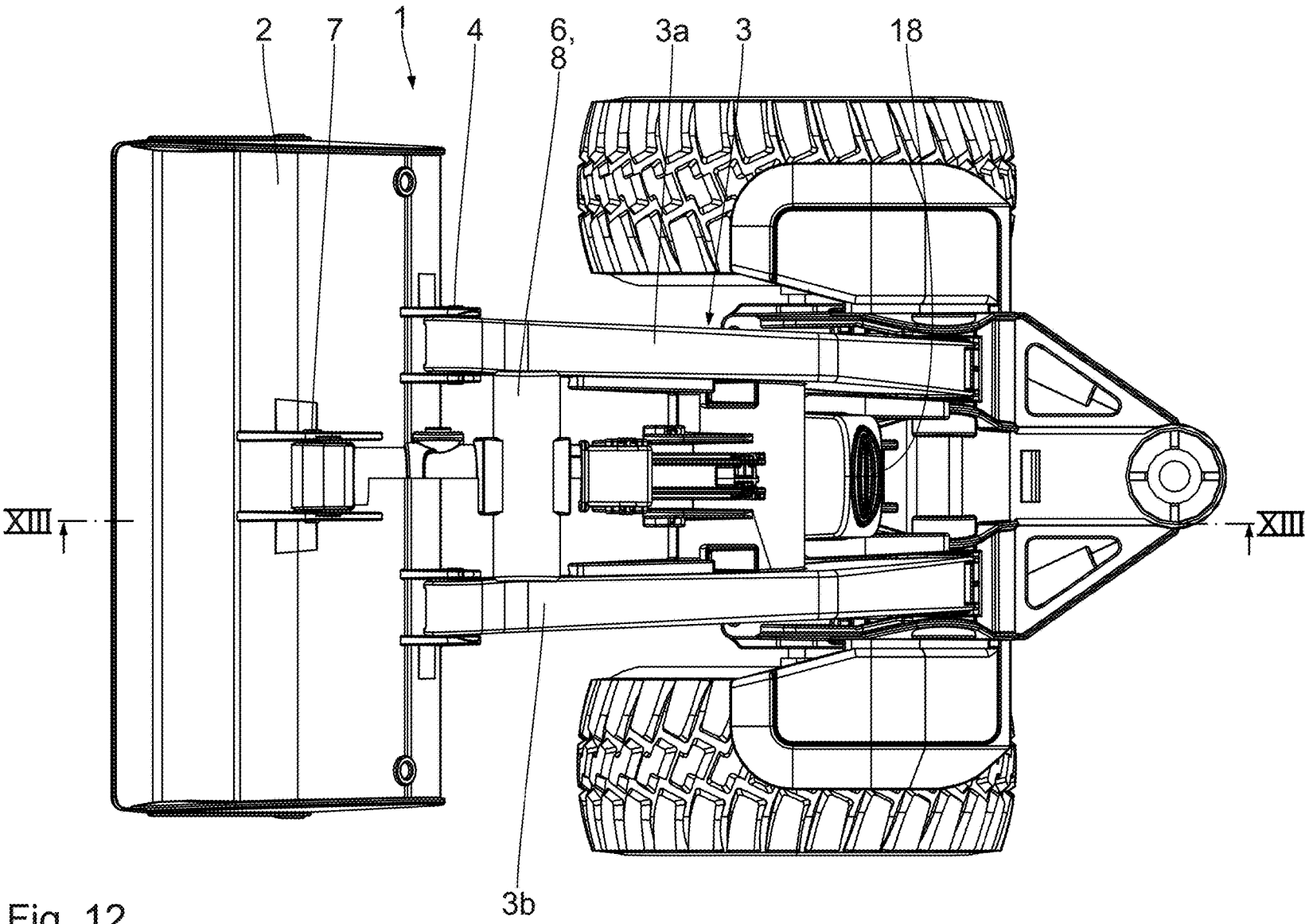
FIG. 12 is a view similar to FIG. 1, the vehicle section with the excavator shovel in a shovel delivery position and the shovel arm still in the shovel arm lifting position.
Figure 13:
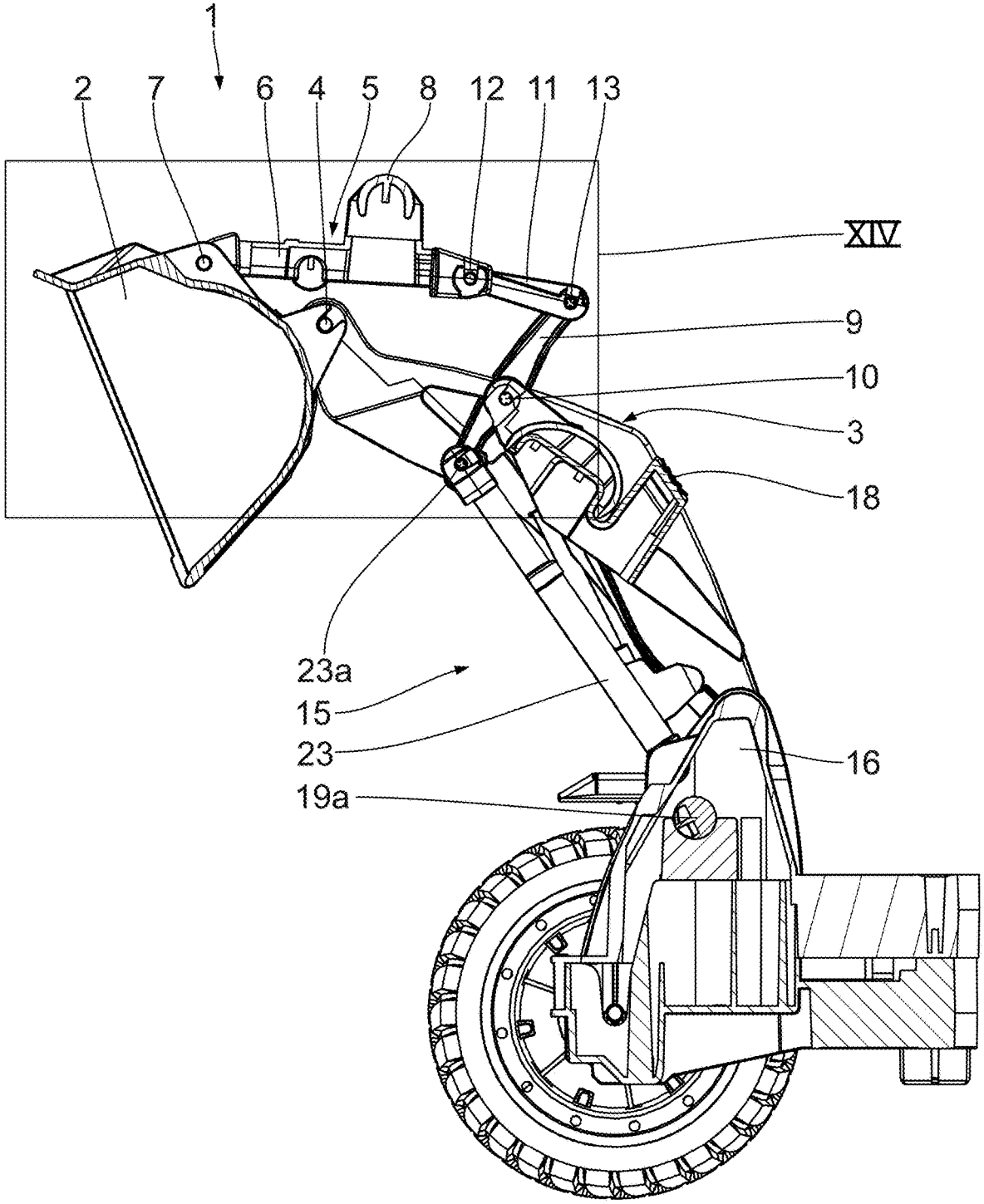
FIG. 13 is a cross sectional view according to line XIII-XIII in FIG. 12.
Figure 14:
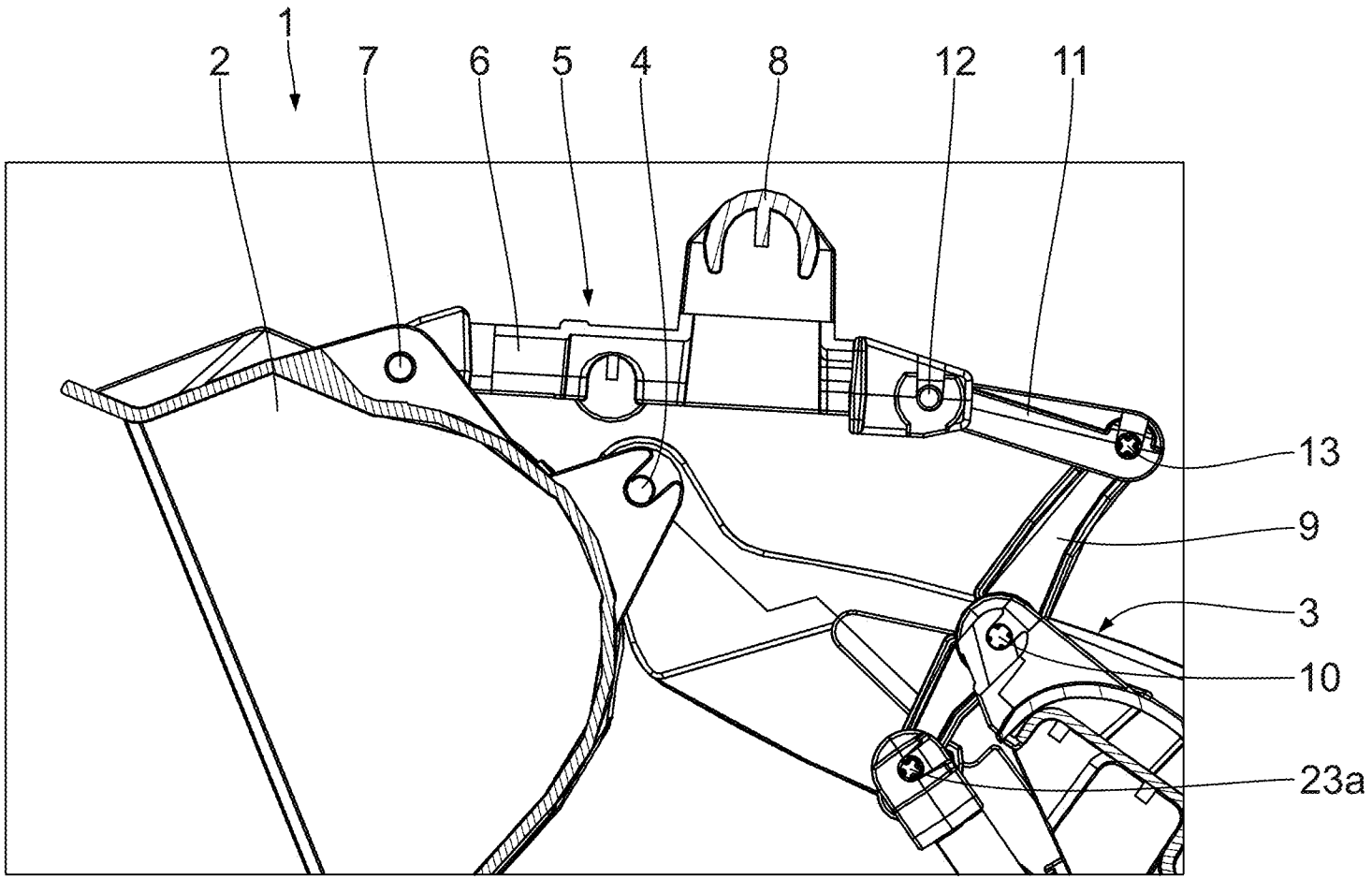
FIG. 14 shows a detail XIV of FIG. 13.
Figure 15:
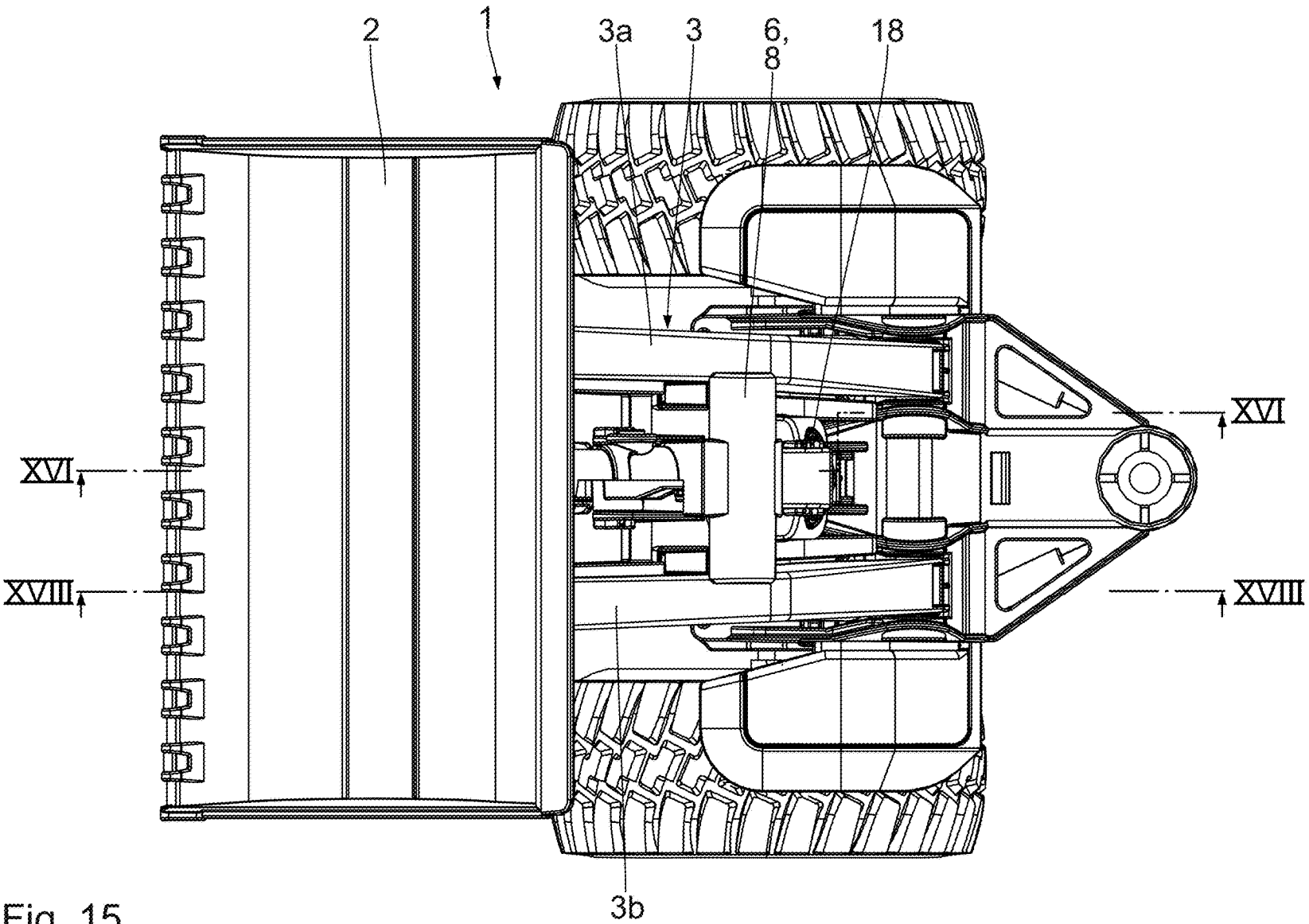
FIG. 15 is a view similar to FIG. 1, the vehicle section with the excavator shovel in the shovel lifting position and an actuating handle in a release position, in which the shovel arm is displaceable to a shovel arm lowering position.
Figure 16:
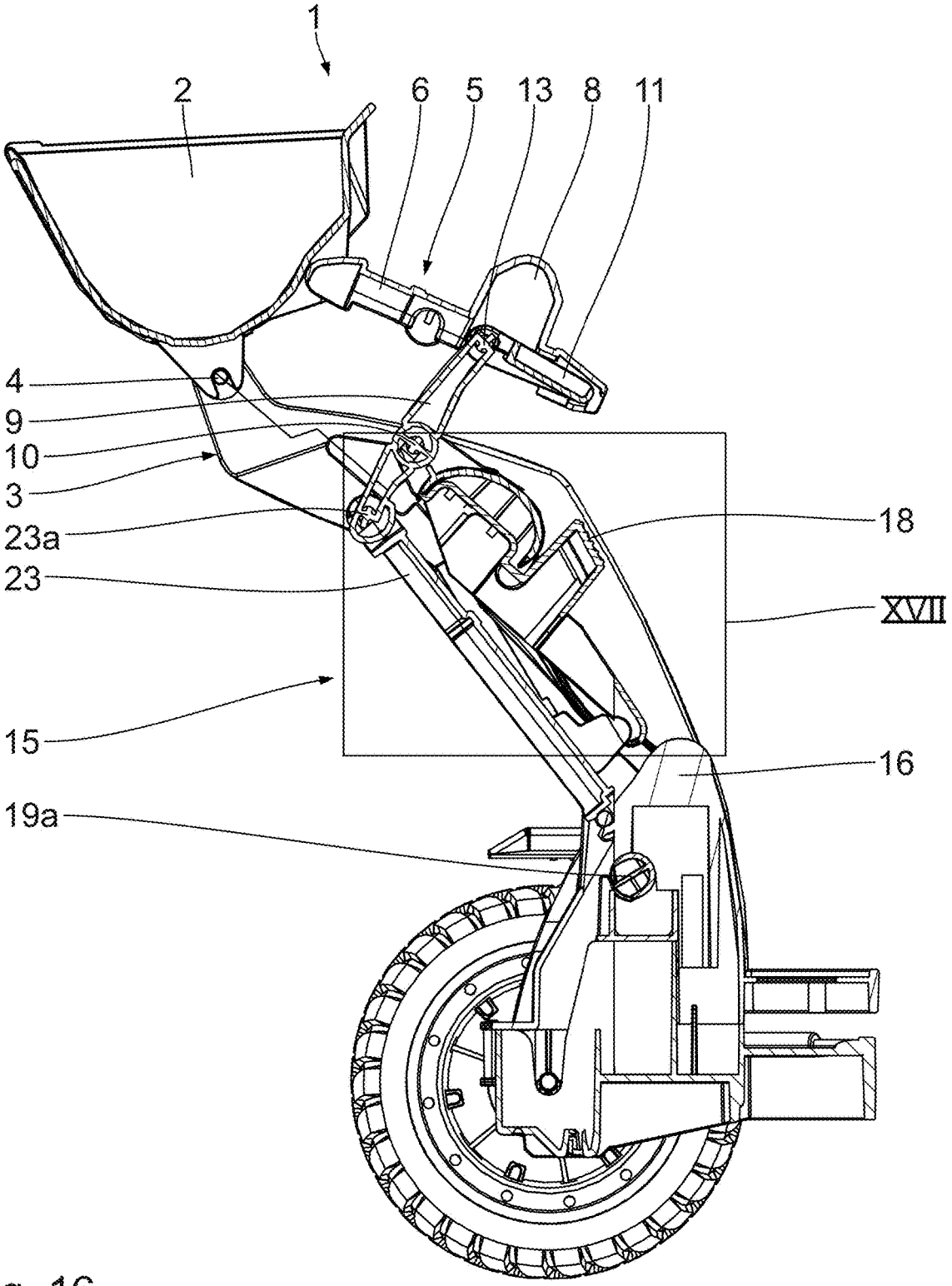
FIG. 16 is a cross sectional view according to line XVI-XVI in FIG. 15.
Figure 27:
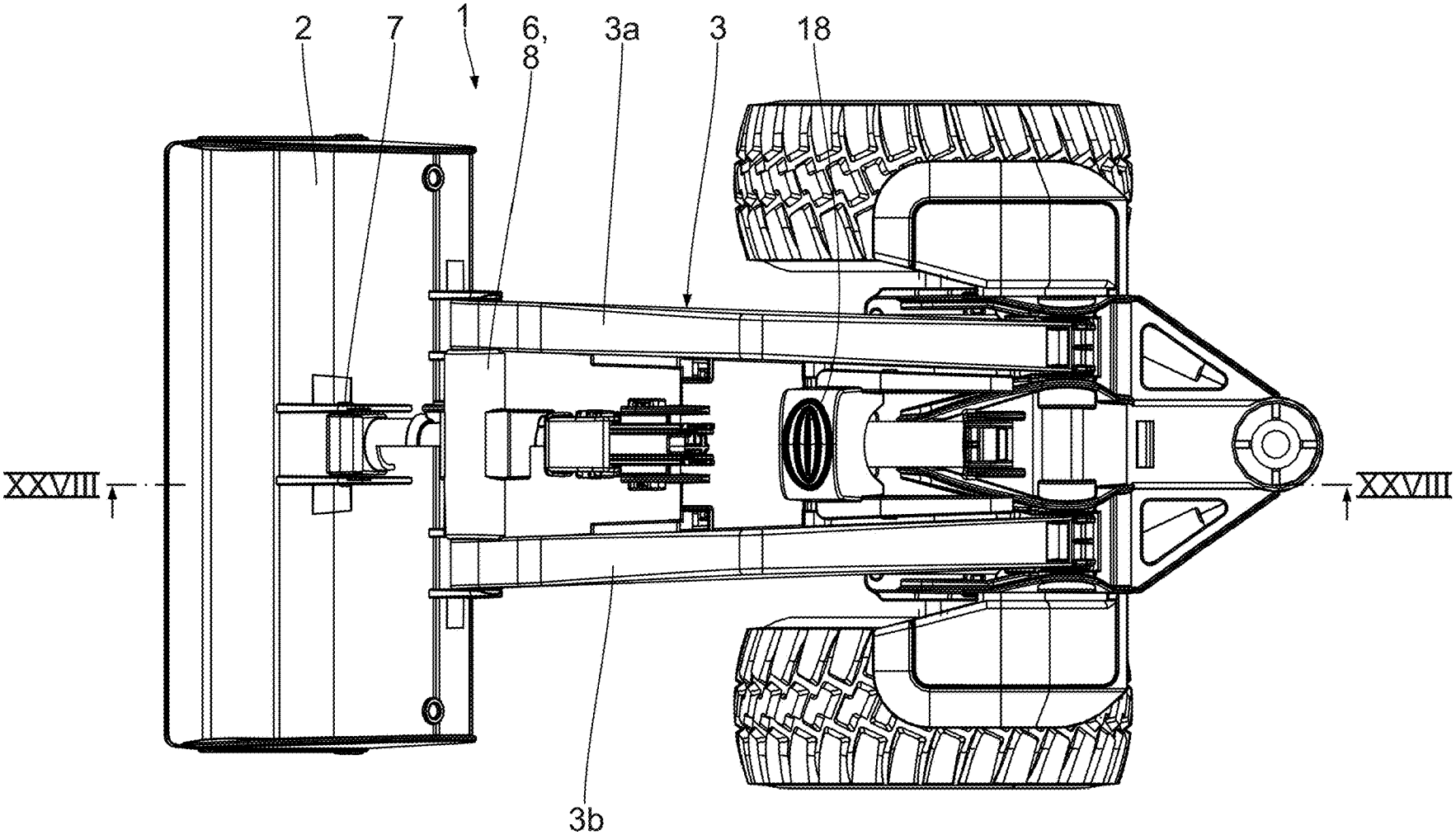
FIG. 27 is an illustration similar to FIG. 1, the vehicle section with the excavator shovel still in the shovel delivery position, wherein the shovel arm is lowered to a position close to the shovel arm lowering position until the ground contact of the excavator shovel.
Figure 28:
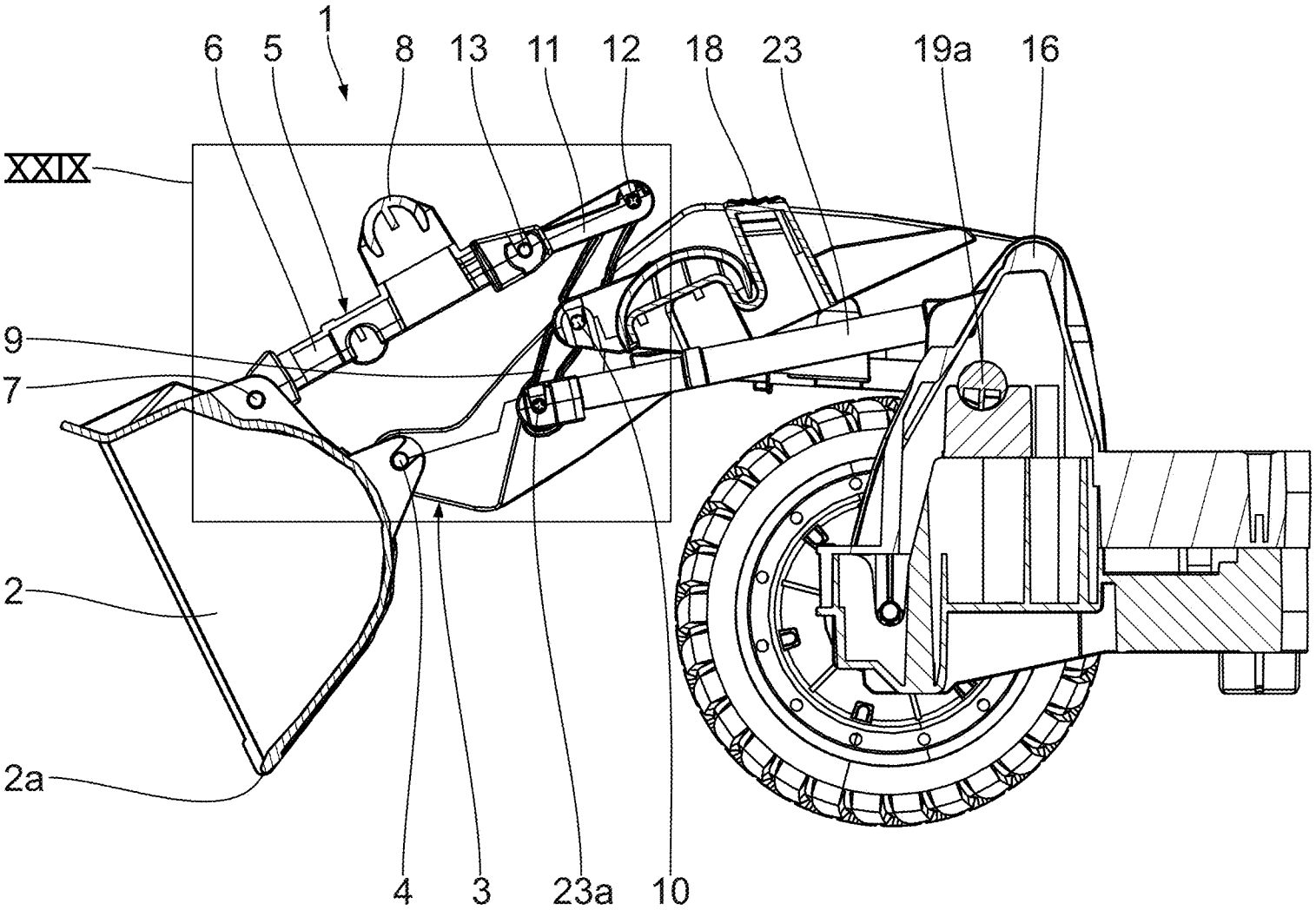
FIG. 28 is a cross sectional view according to line XXVIII-XXVIII in FIG. 27.
Figure 29:
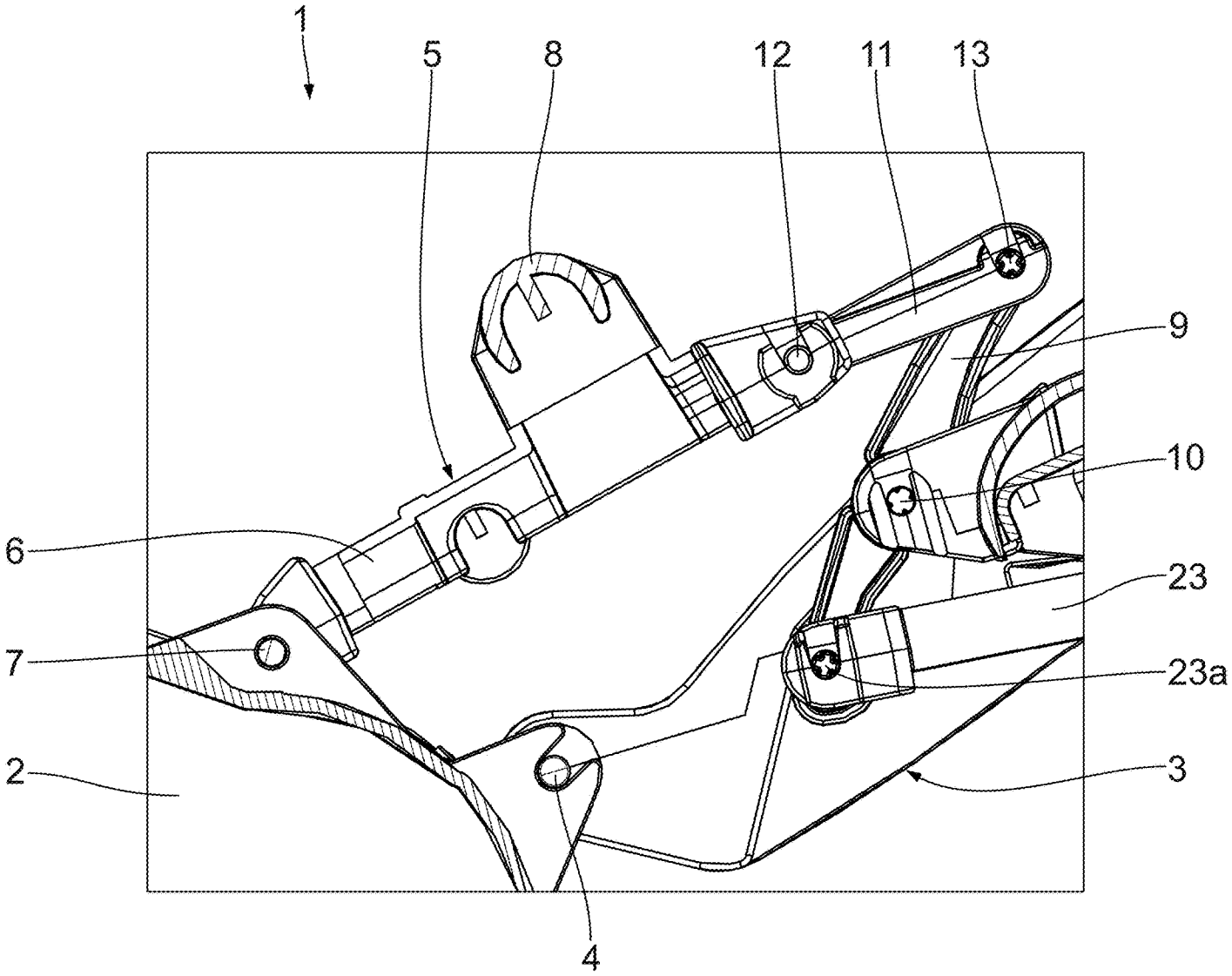
FIG. 29 shows a detail XXIX of FIG. 28.
Figure 30:
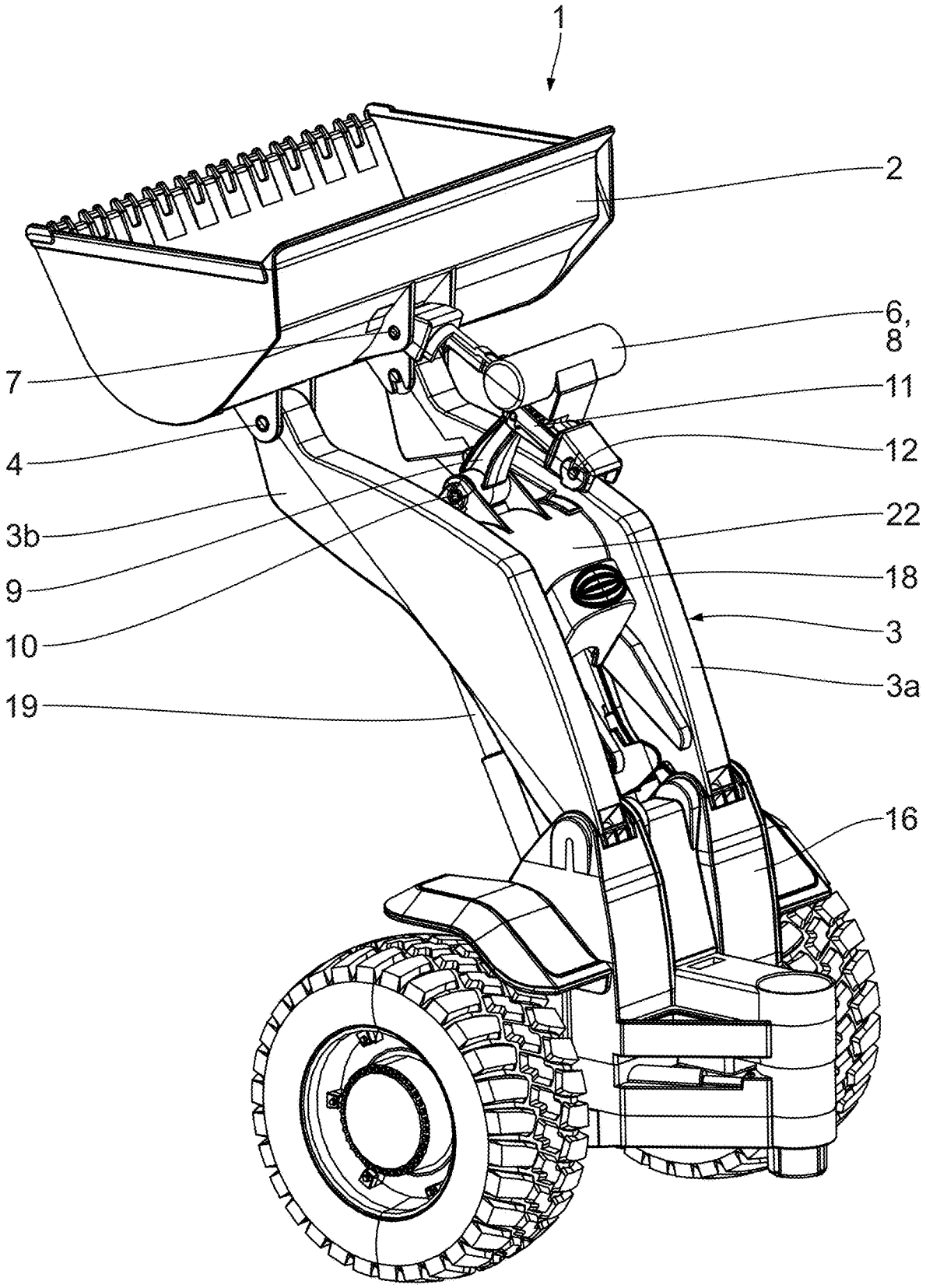
FIG. 30 is a perspective illustration of the vehicle section in the position of the excavator shovel and shovel arm according to FIGS. 27 to 29.

The shovel connecting joint 7 and the two rocker connecting joints 12, 13 are arranged relative to each other in such a manner that the rocker connecting lever can be displaced between the shovel lifting position shown in FIGS. 1 to 8 and a shovel delivery position shown in FIGS. 12 to 14 and, for example, also in FIGS. 27 to 29 via a dead center position in which the shovel arm rocker connecting joint 13 passes through a dead center joint plane 14.

The dead center joint plane 14 is indicated by the joint axes 7, 12 on the one hand of the shovel connecting joint, and on the other hand of the shovel rocker connecting joint.

Figure 3:
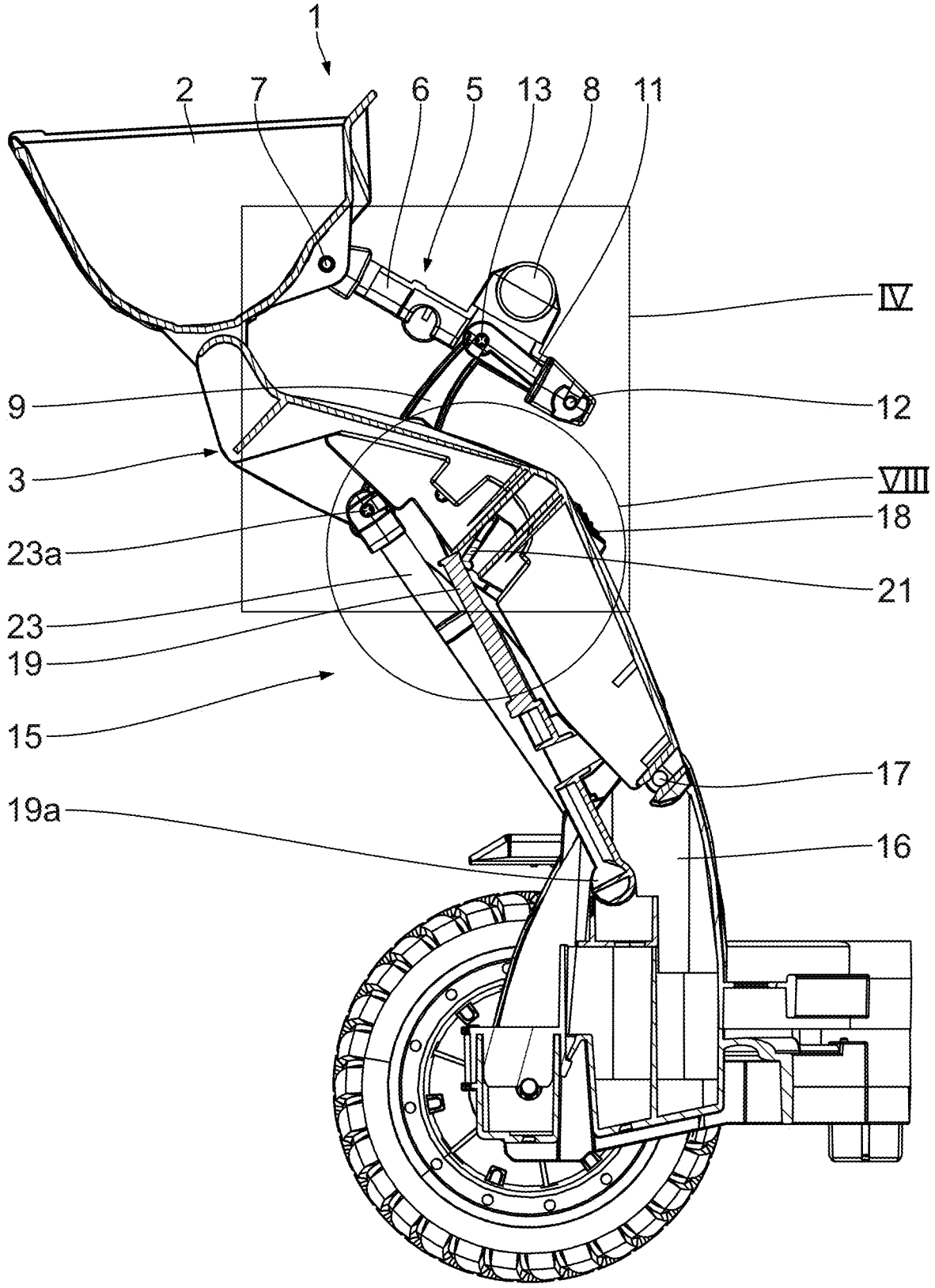
FIG. 3 is a cross sectional view according to line in FIG. 1.
Figure 4:
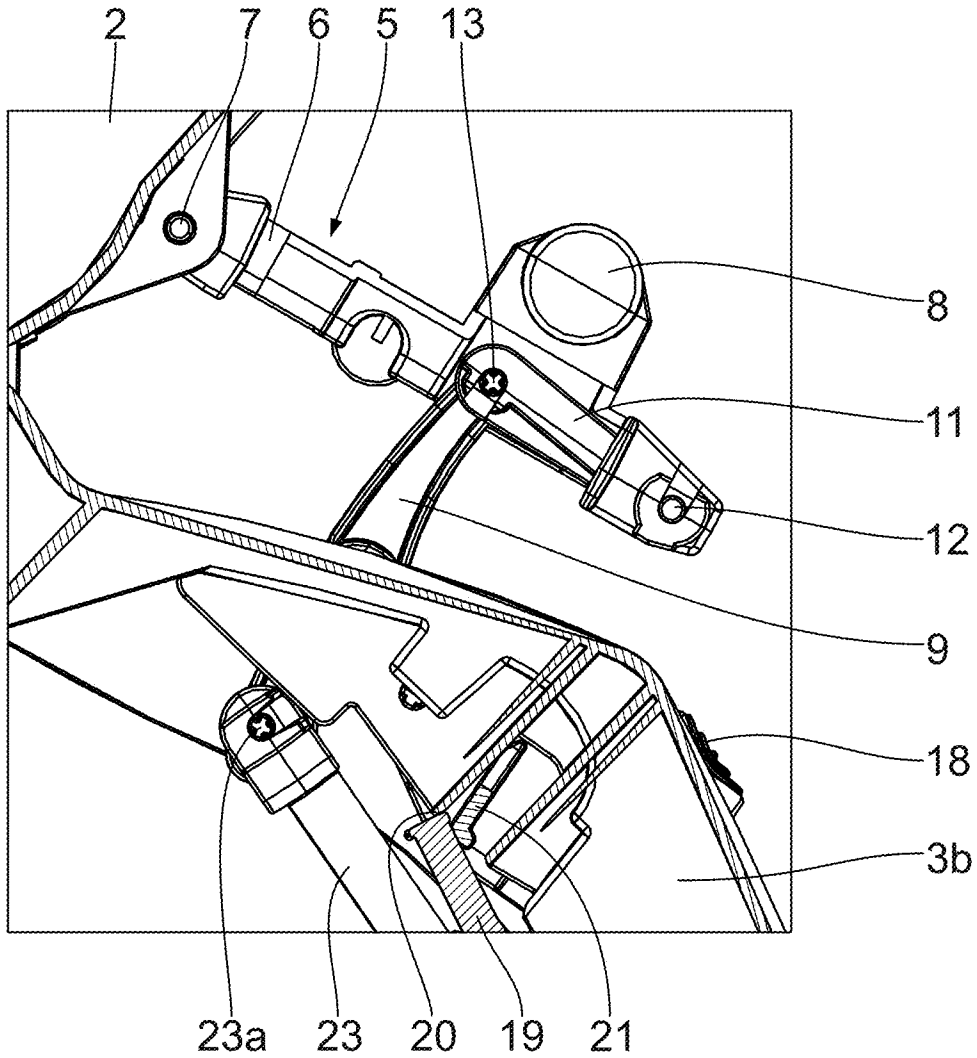
FIG. 4 shows a detail IV of FIG. 3.
Figure 5:
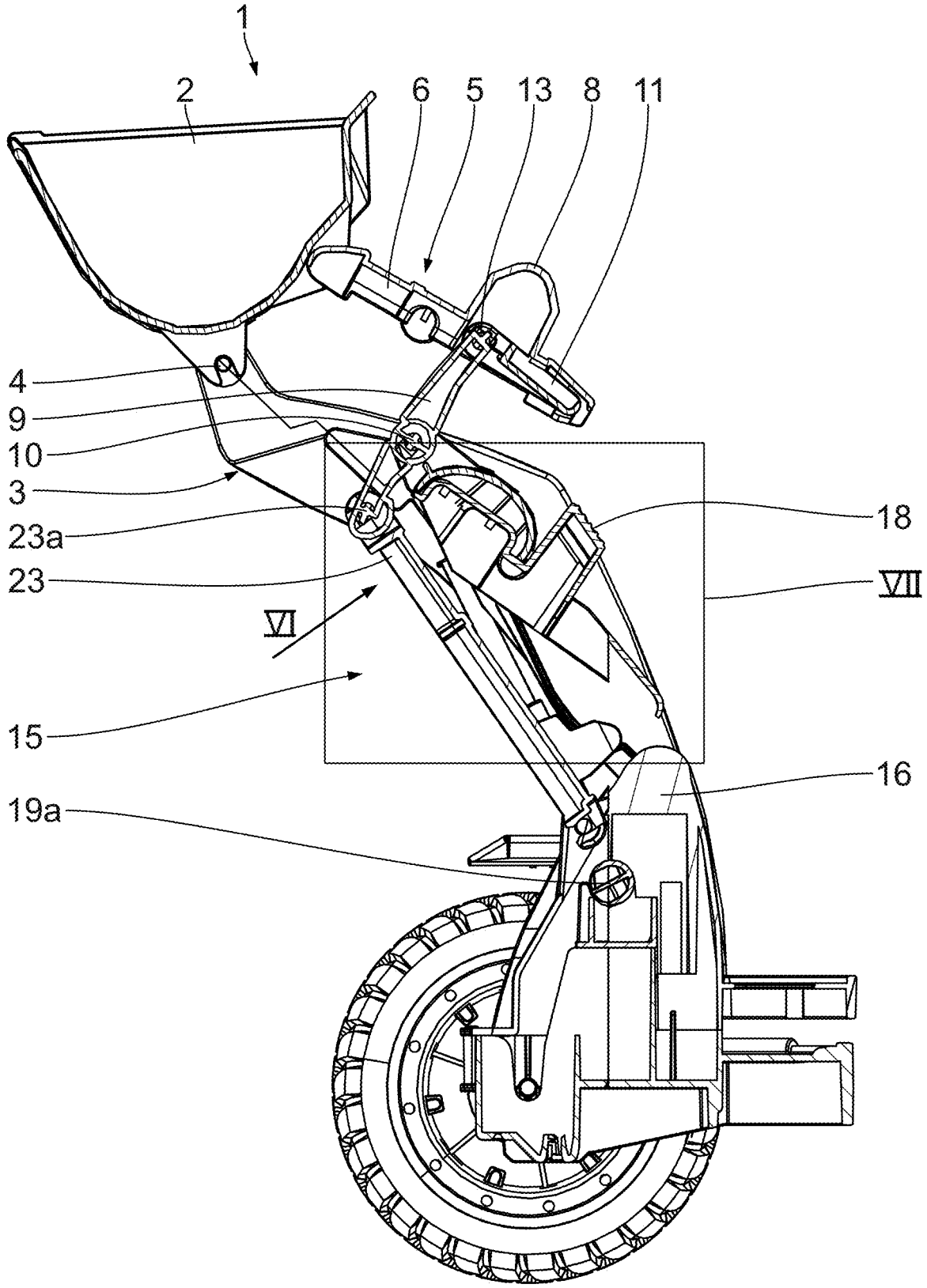
FIG. 5 is a cross sectional view according to line V-V in FIG. 1.
Figure 6:
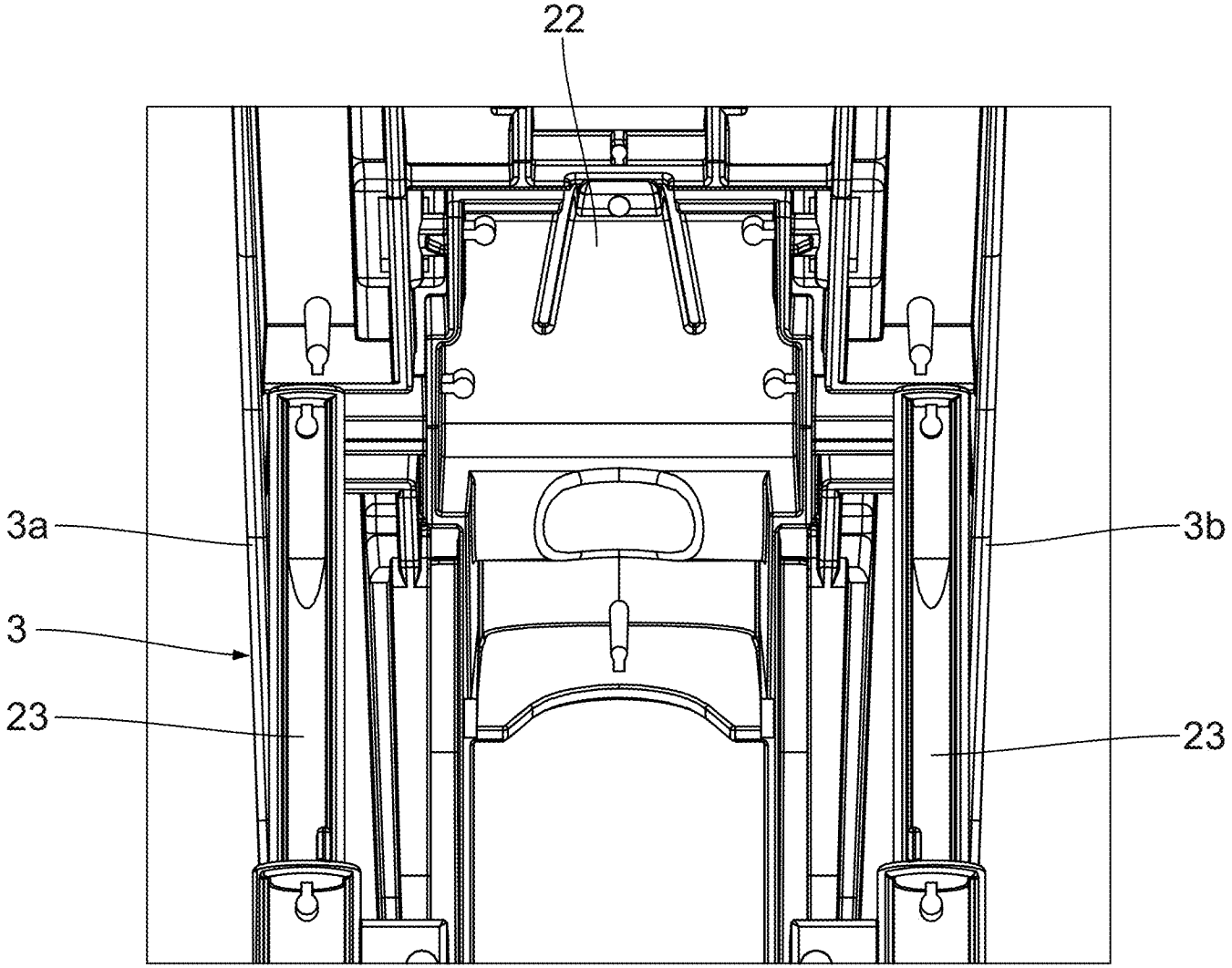
FIG. 6 is a bottom view of a detail of the vehicle section according to Line VI in FIG. 5.
Figure 7:
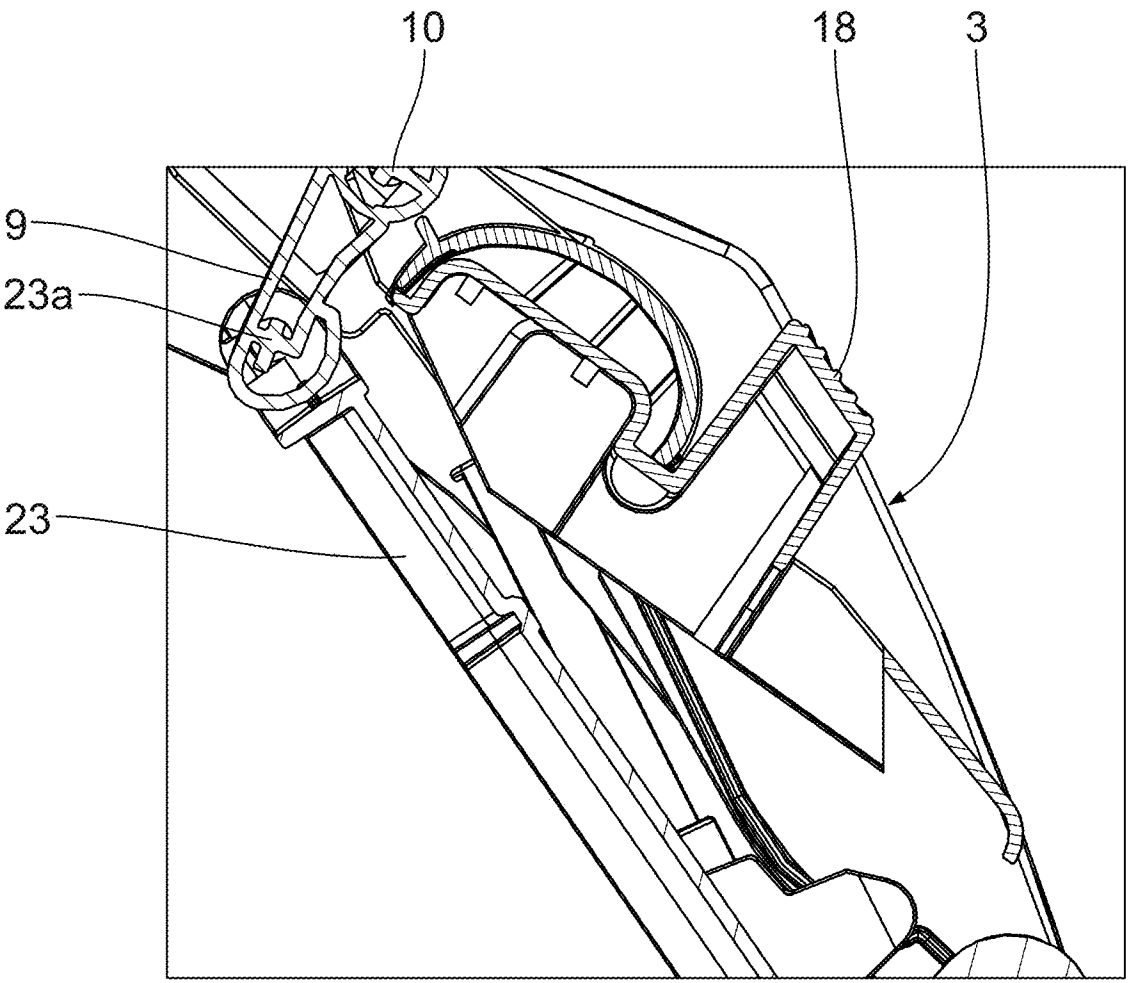
FIG. 7 shows a detail VII of FIG. 5.

In the position shown in FIGS. 3 and 4, for example, the joint axis 13 of the shovel arm rocker connecting joint is at a distance from the dead center joint plane 14.

Figure 9:
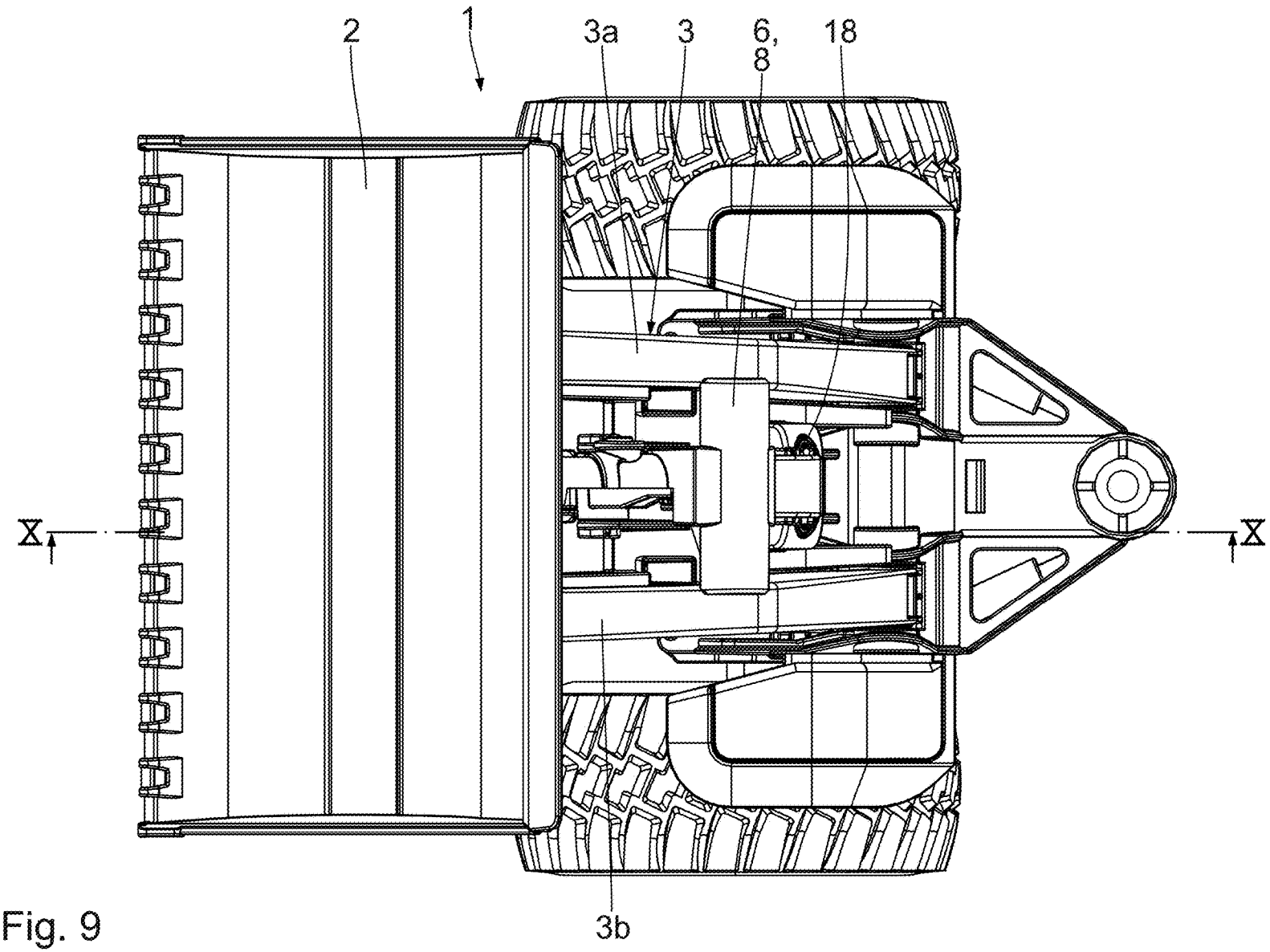
FIG. 9 is a view similar to FIG. 1, the vehicle section, wherein the excavator shovel is in a shovel dead center position of a shovel swivel locking device and the shovel arm is still in the shovel arm lifting position.
Figure 10:
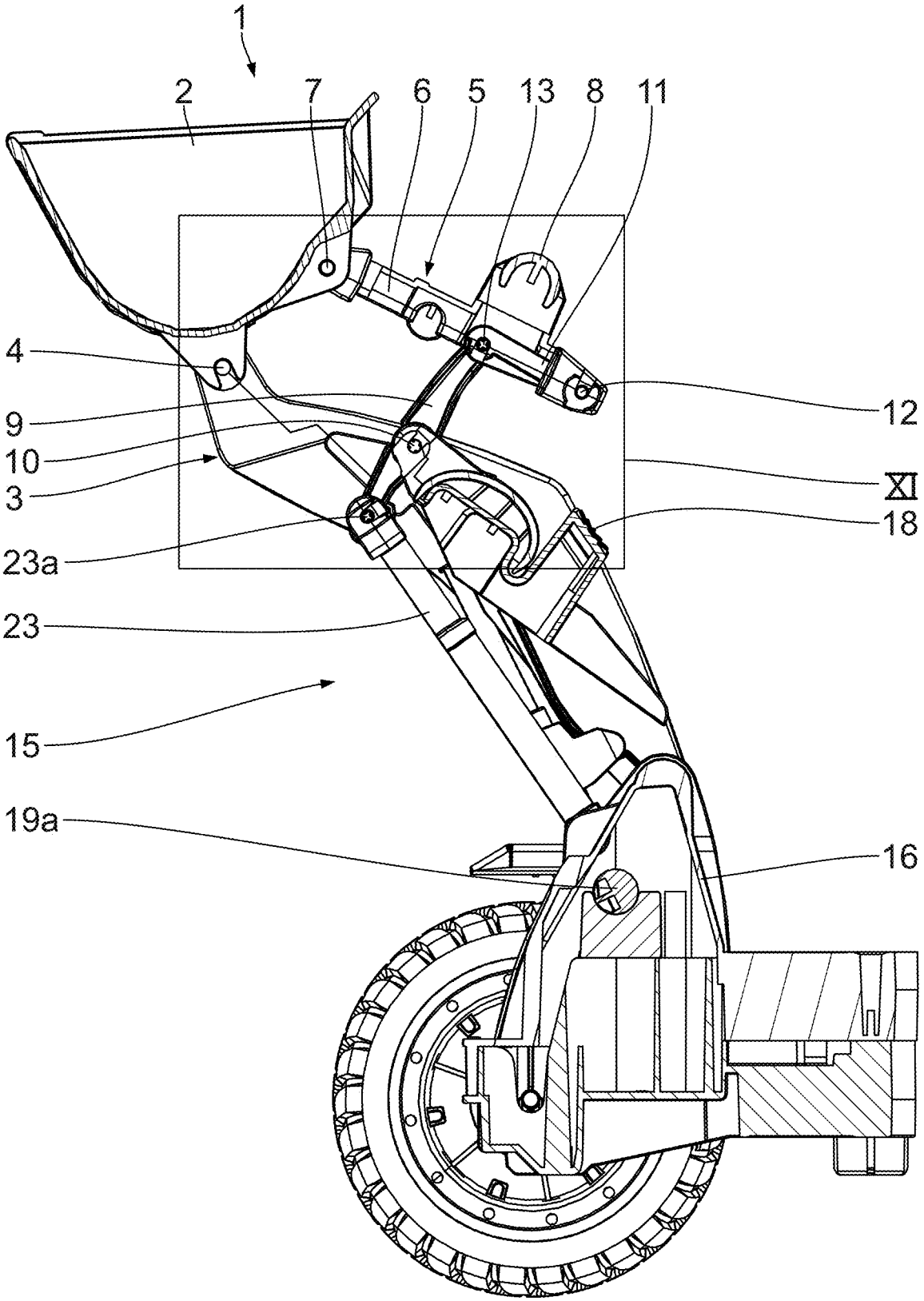
FIG. 10 is a cross sectional view according to line X-X in FIG. 9.
Figure 11:
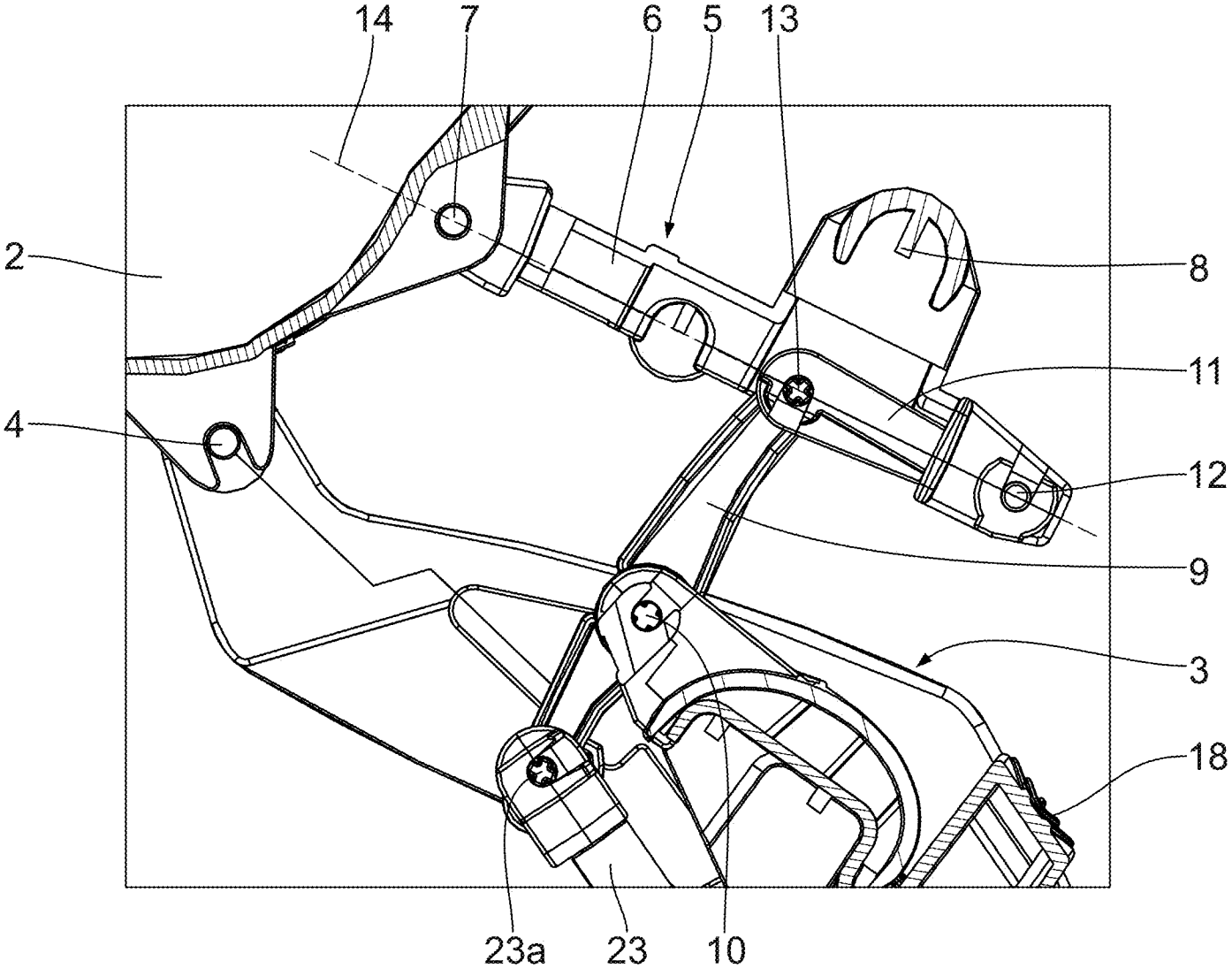
FIG. 11 shows a detail XI of FIG. 10.

The shovel dead center position is shown in FIGS. 9 to 11. In this dead center position, the joint axis of the shovel rocker connecting joint 13 lies in the dead center joint plane 14.

In the shovel lifting position, the excavator shovel 2 is in a raised lifting swivel position relative to the shovel arm 3. In the shovel delivery position, the excavator shovel 2 lies relative to the shovel arm 3 in a delivery swivel position swiveled downwards relative to the shovel lifting position.

After overcoming the shovel dead center position, starting from the shovel lifting position, the shovel delivery position can be reached under the dead weight of the excavator shovel 2. The dead center of the rocker connecting lever 11 is overcome, starting from the shovel lifting position, by pulling on the operating handle 8, such that the shovel connecting lever 6 pivots around the shovel connecting joint 7, until, starting from the locking position of the shovel swivel locking device 5, for example according to FIG. 4, the dead center is reached, which is reached for example in FIG. 11. Then, under the dead weight of excavator shovel 2, the shovel delivery position is reached, for example, according to FIGS. 12 to 14.

An excavator structure 15, of which the excavator shovel assembly 1 is a part, also includes a frame component 16, which is a part of a frame of the excavator structure 15. The shovel arm 3 is connected to the frame component 16 via a shovel arm swivel joint with joint axis 17.

Figure 17:
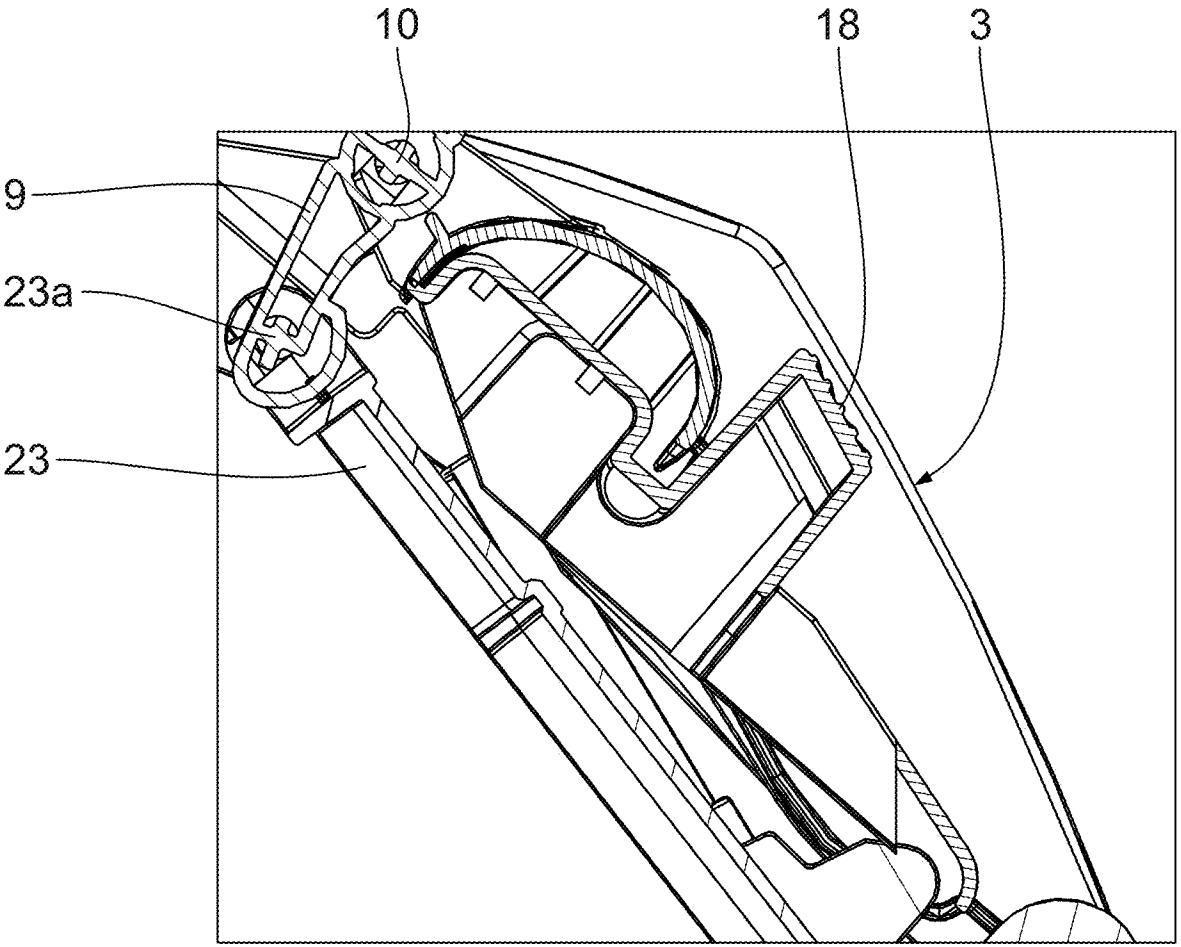
FIG. 17 shows a detail XVII of FIG. 16.
Figure 18:
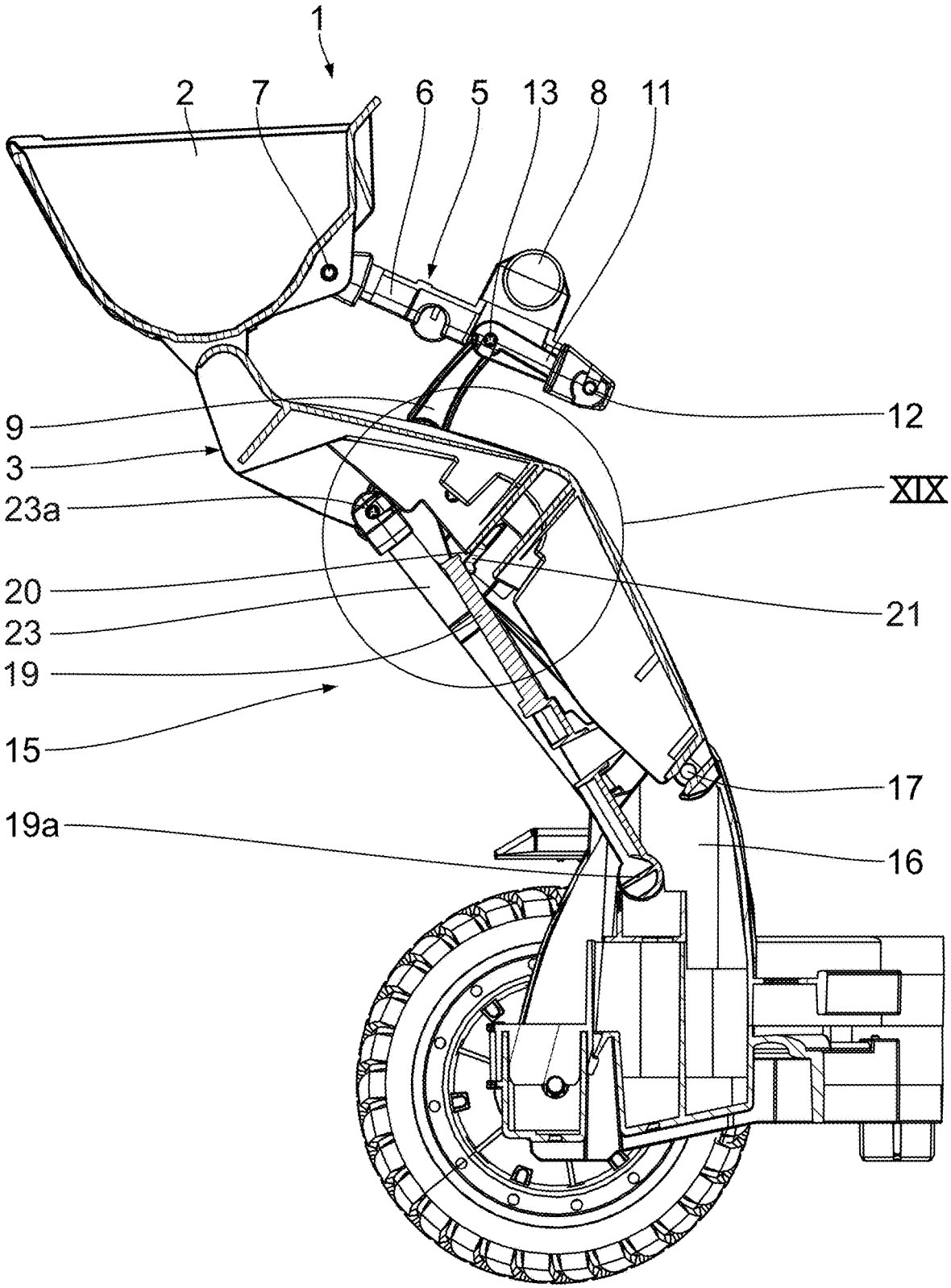
FIG. 18 is a cross sectional view XVIII-XVIII in FIG. 15.

The excavator structure 15 also includes an actuating component 18, which is designed as an actuating knob. The actuating component 18 is guided relative to the shovel arm 3 and can be displaced between a locking position shown for example in FIG. 7 and a release position shown for example in FIG. 17. In the locking position, a locking element 19 interacts with a stop 20 of the shovel arm 3 to hold the shovel arm 3 in the shovel arm lifting position (see FIG. 8).

The locking element 19 is designed in the form of a stylized piston. The locking element 19 is connected to the frame component 16 via a bolt connecting joint with joint axis 19*a*. As with the shovel arm 3, the locking element 19 is also available with a double design.

In the locking position, one end face of the locking element 19 interacts with the stop 20 of the shovel arm 3. In the locking position, a section 21 of the actuating component 18 rests against a jacket wall of the locking element 19 (see FIG. 8).

Figure 8:
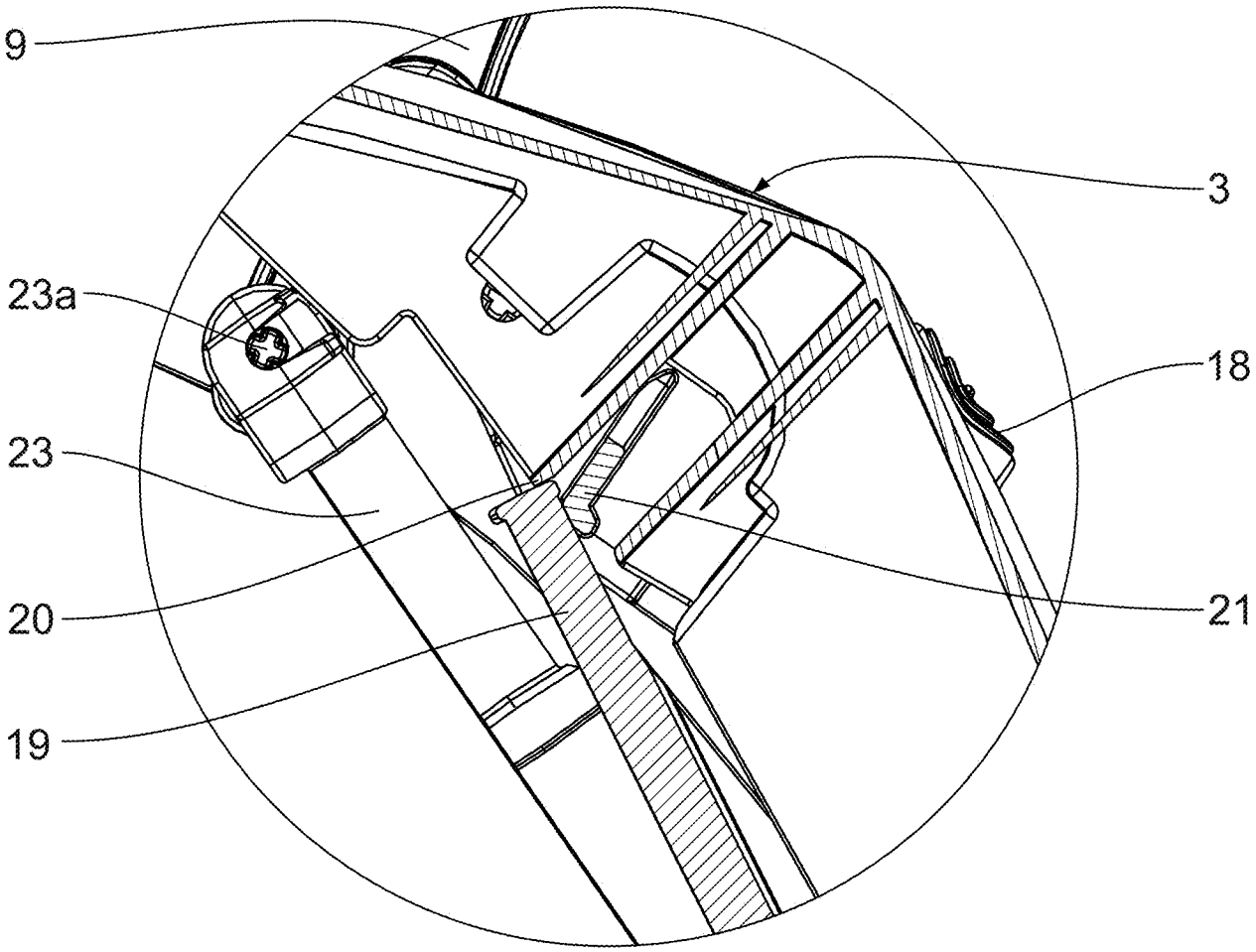
FIG. 8 shows a detail VIII of FIG. 3.
Figure 19:
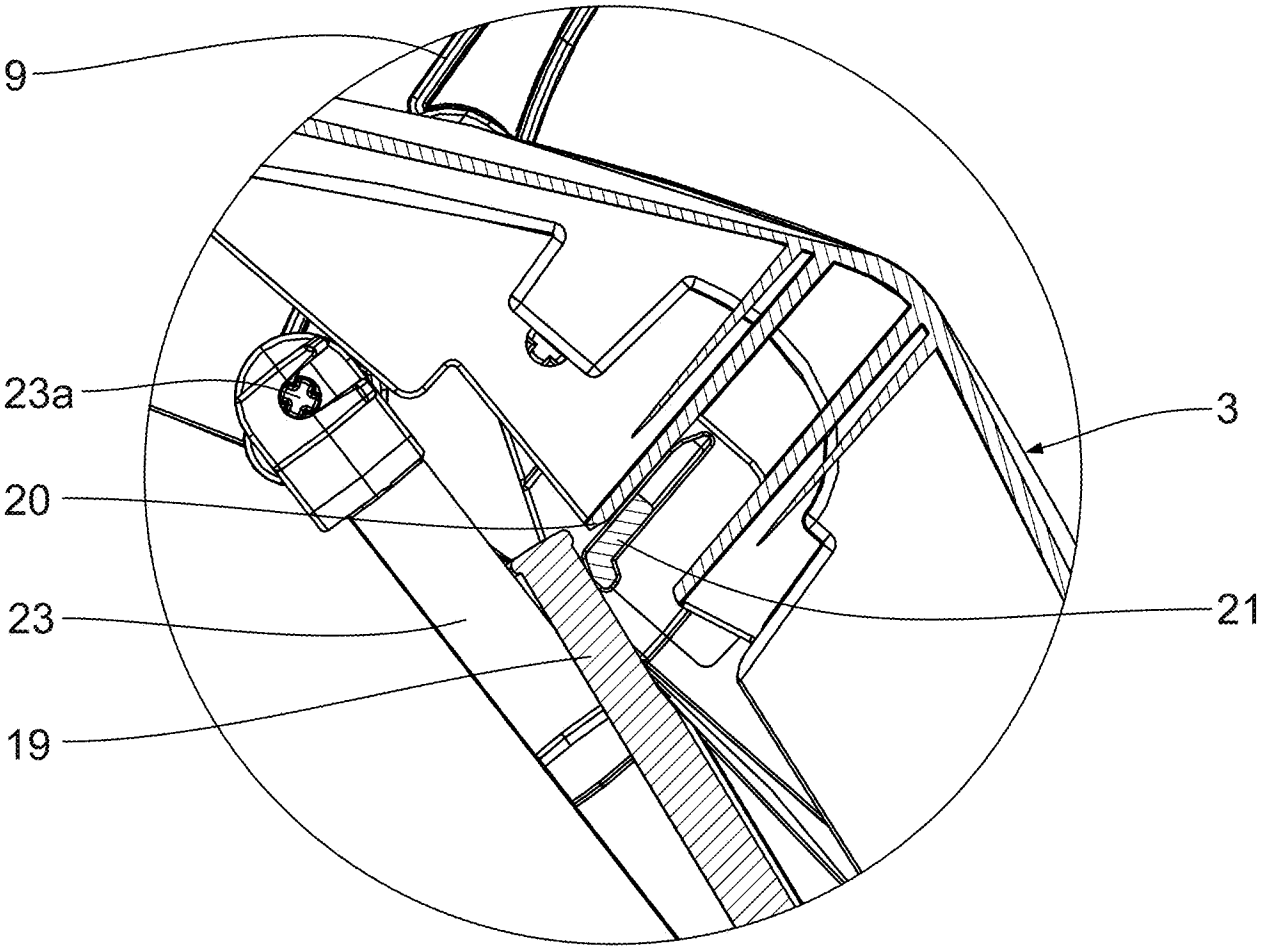
FIG. 19 shows a detail XIX of FIG. 18.
Figure 20:
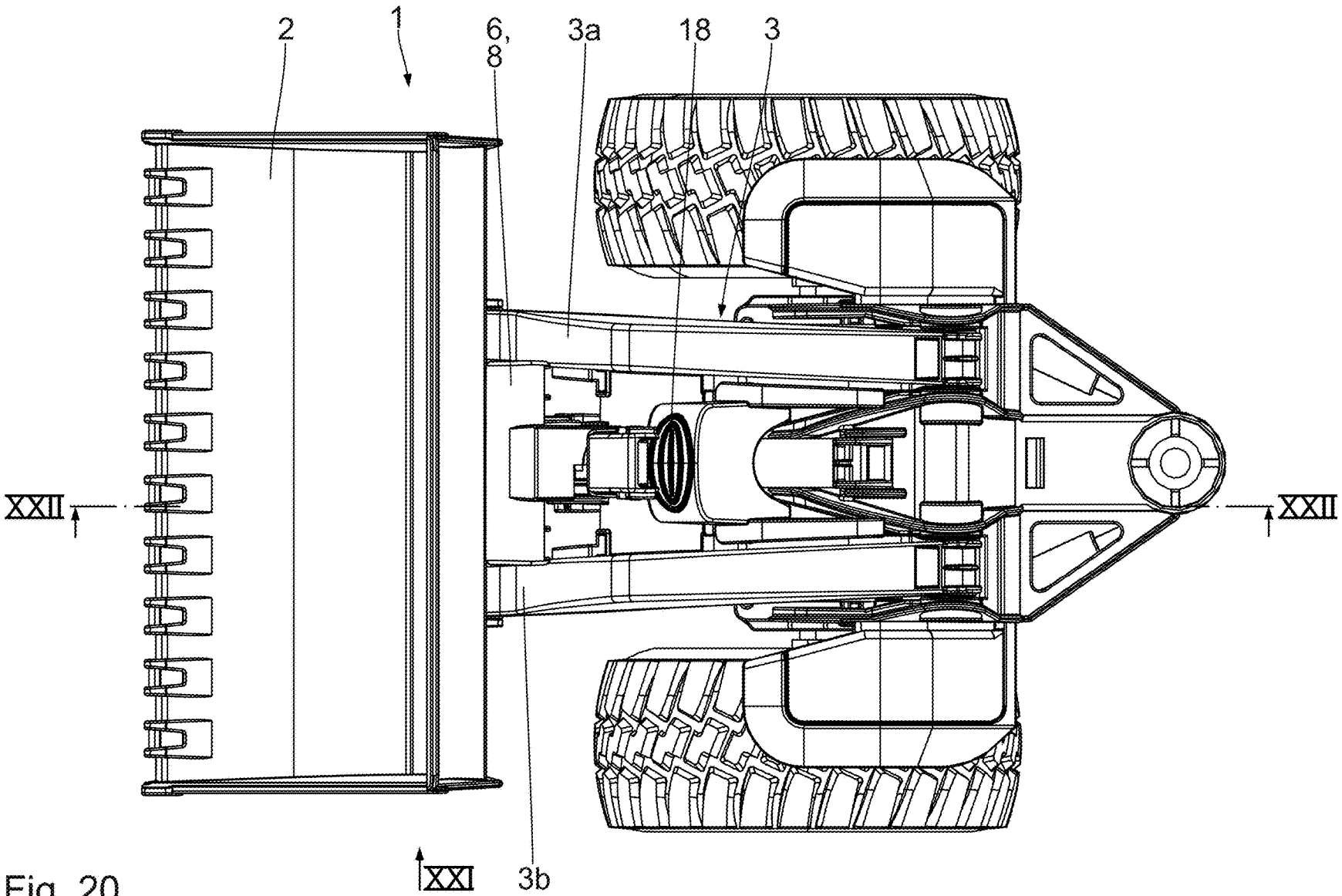
FIG. 20 is a view similar to FIG. 1, the vehicle section with the excavator shovel still in the shovel lifting position and the shovel arm in a shovel arm lowering position.
Figure 21:
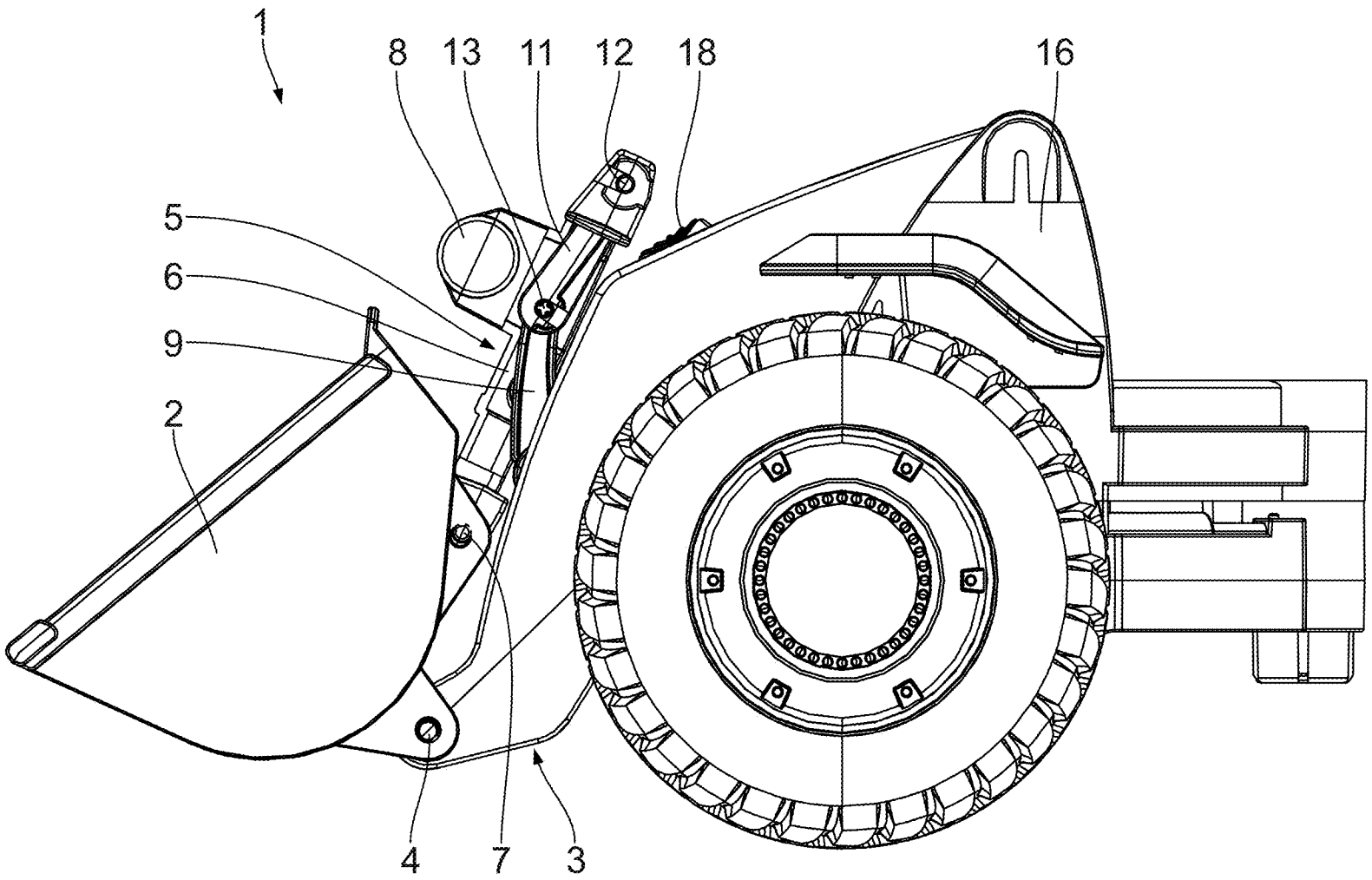
FIG. 21 is a side view of the vehicle section, seen from view direction XXI in FIG. 20.

In the release position of the actuating component 18 (see FIG. 19), the section 21 of the actuating component 18 adjacent to the locking element 19 is also displaced and, as can be seen by comparison of FIGS. 8 and 19, pushes the locking element 19 away from the stop 20, such that the locking element 19 is released from the shovel arm 3.

In the release position, the locking element 19 is out of engagement with the stop 20 of the shovel arm 3, such that the shovel arm 3 can be displaced into the shovel arm lowering position.

Via a spring component 22 designed as a spring tongue (see FIG. 6), the actuating component 18 is pretensioned in the locking position.

The excavator structure 15 is part of a toy, in particular a toy vehicle, which may be designed as an excavator in its entirety.

The excavator shovel assembly 1, the excavator structure 15 and the entire toy can be manufactured of plastic. The individual components can be manufactured as injection molded parts.

When playing with a toy having the excavator structure 15, the operator can switch between the different shovel positions and the different shovel arm positions shown in the figures with the assistance of, on the one hand, the operating handle 8 and, on the other hand, the operating component 18. Due to the shovel swivel locking device 5, the excavator shovel 2 remains fixed in the shovel lifting position independently of the shovel arm position, unless the operator causes an active changeover of the shovel.

Figure 22:
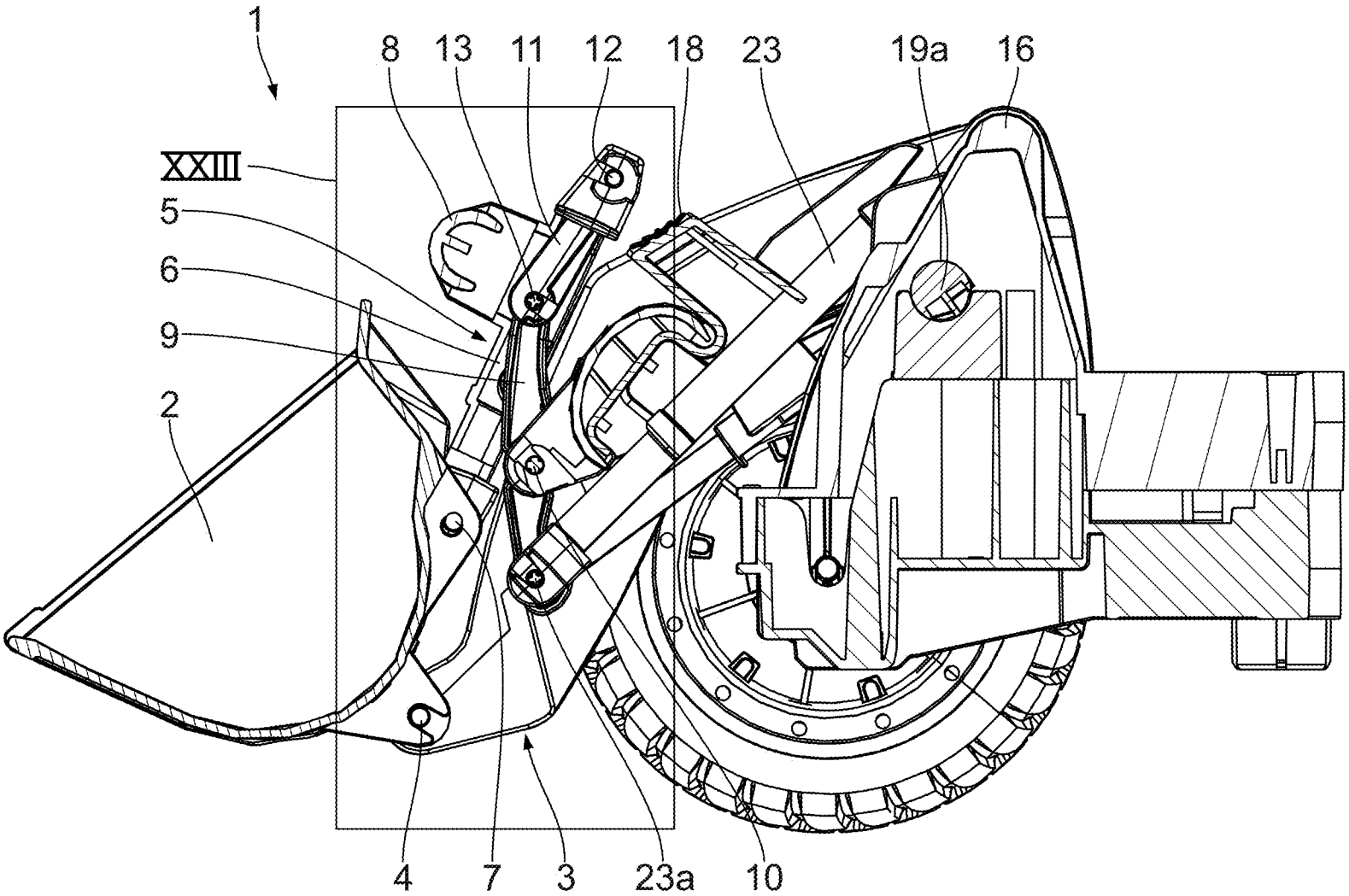
FIG. 22 is a cross sectional view according to line XXII-XXII in FIG. 20.
Figure 23:
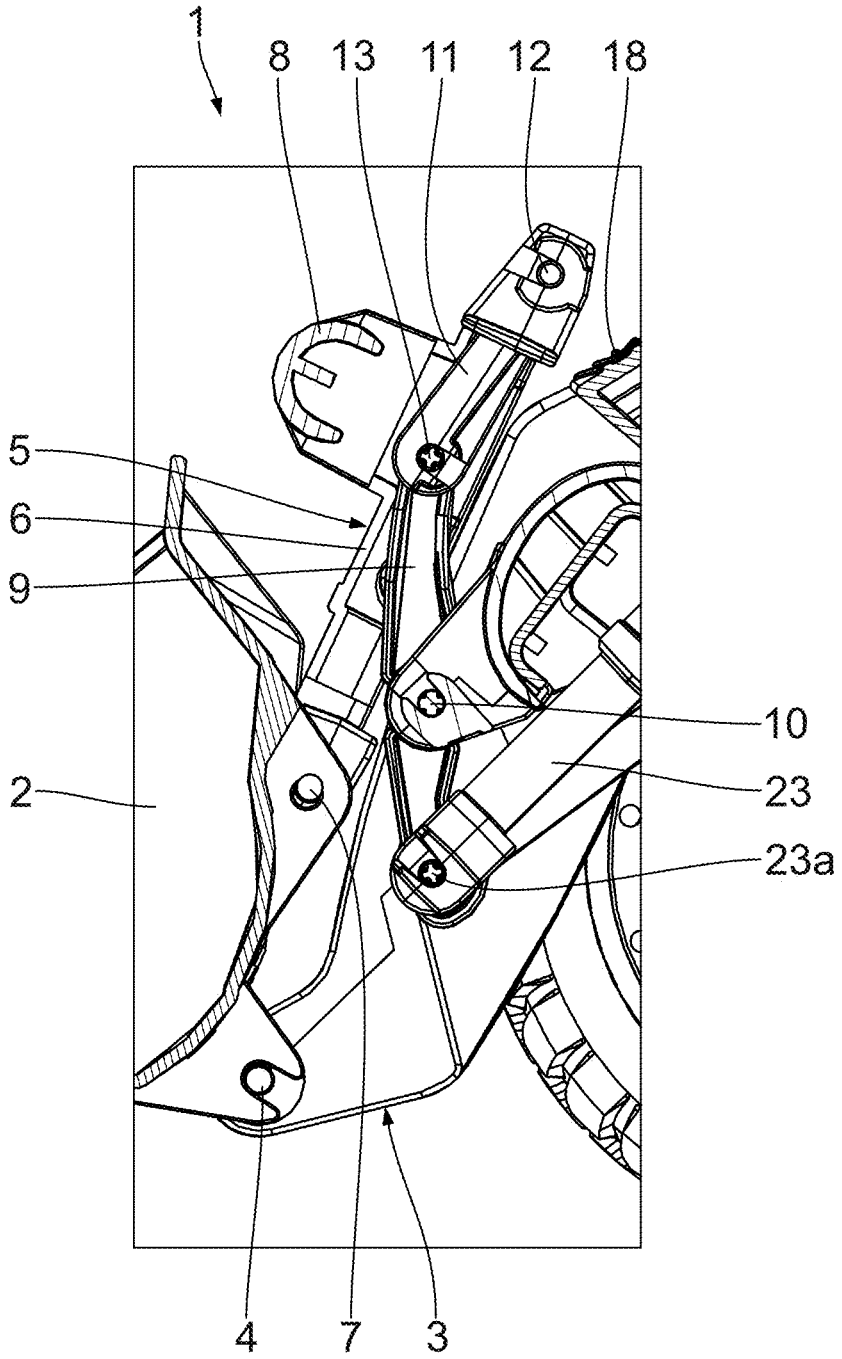
FIG. 23 shows a detail XXIII of FIG. 22.
Figure 24:
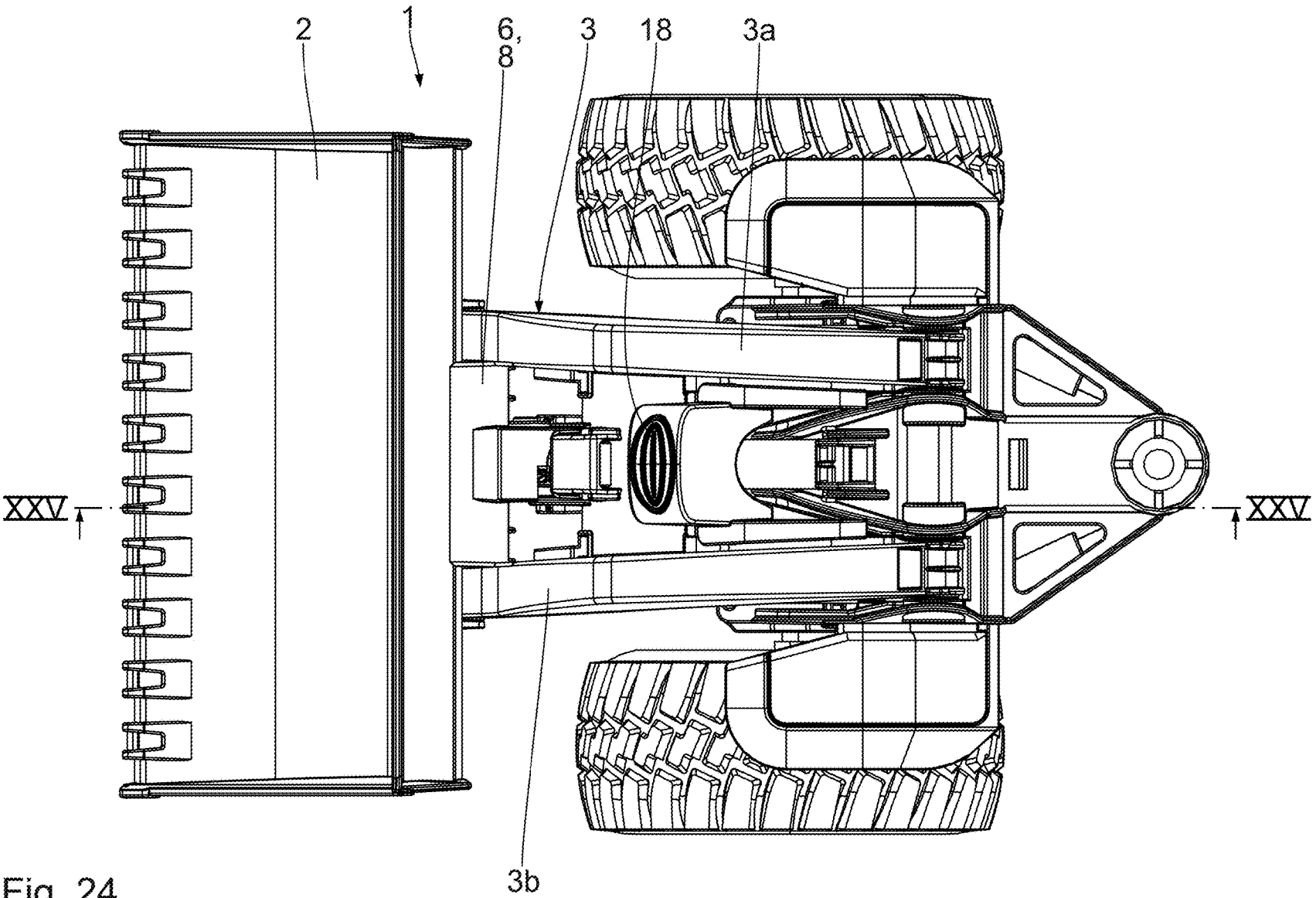
FIG. 24 is a view similar to FIG. 1, the vehicle section with the shovel arm in the shovel arm lowering position and the shovel swivel locking device in the shovel dead center position.
Figure 25:
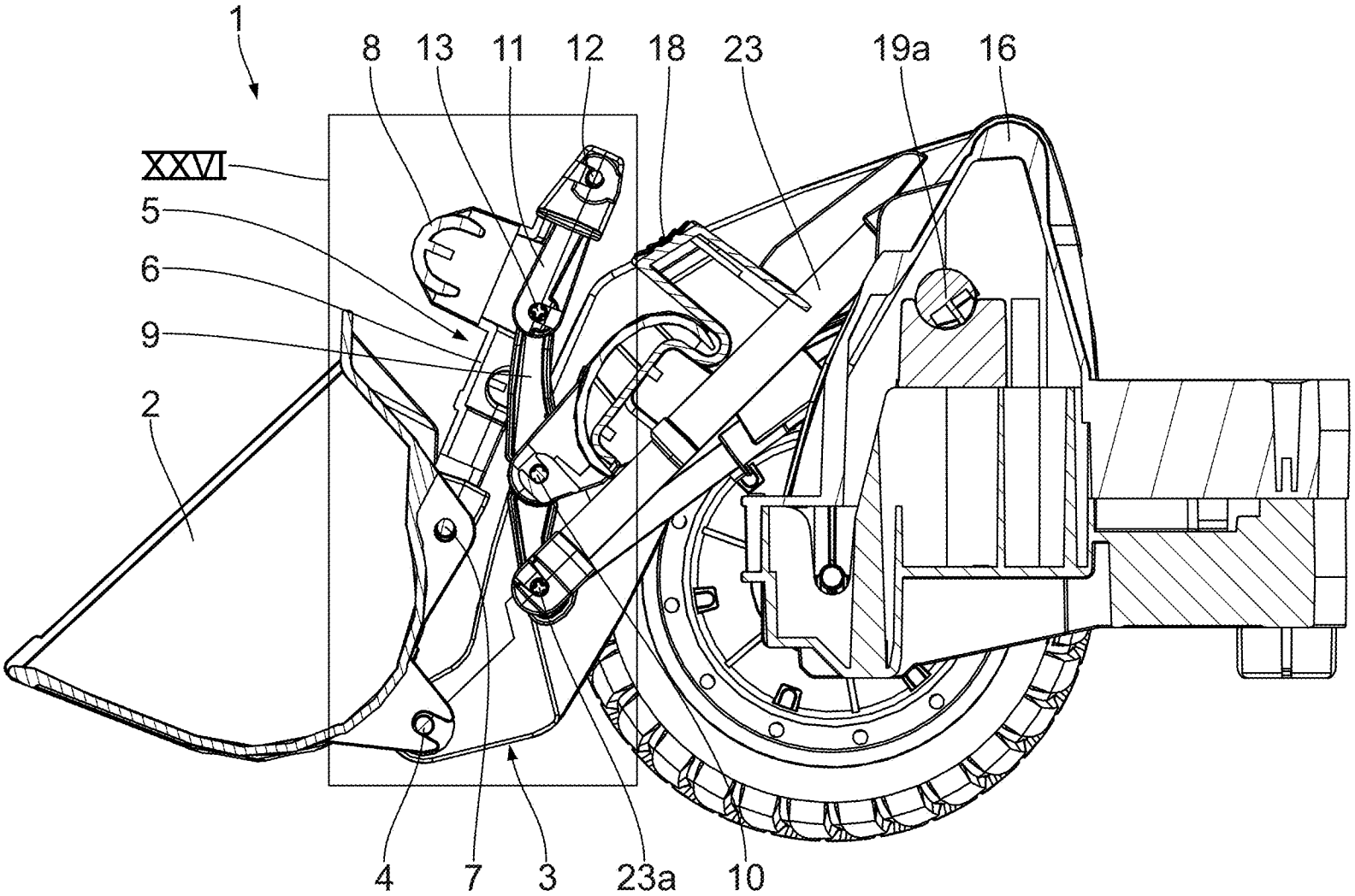
FIG. 25 is a cross sectional view according to line XXV-XXV in FIG. 24.
Figure 26:
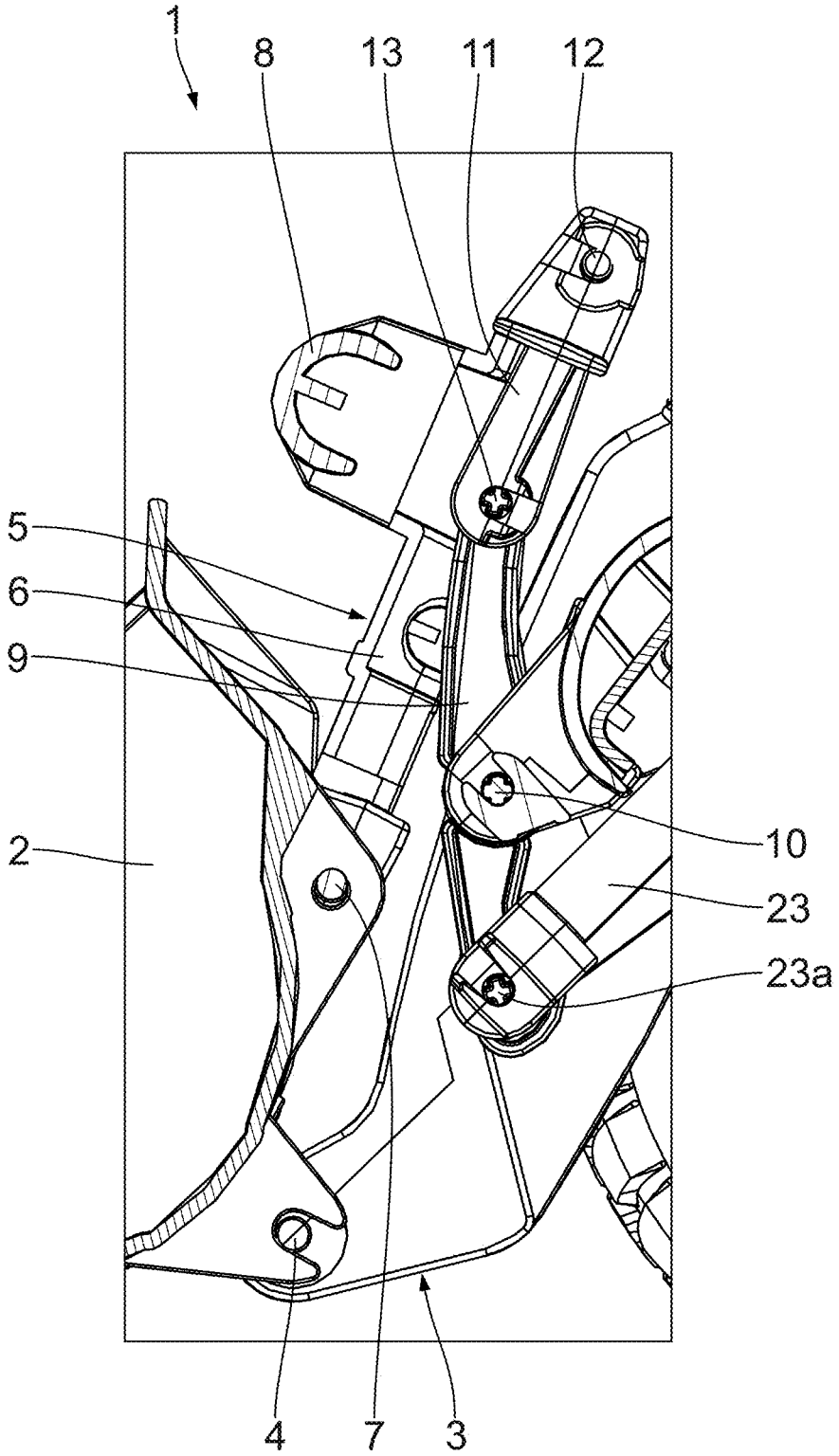
FIG. 26 shows a detail XXVI of FIG. 25.

When the excavator shovel 2 is fixed in the shovel lifting position, the shovel arm connecting lever 9 functions as a part of a parallelogram guide, which ensures that, when the shovel arm 3 moves between the lifting and lowering positions, the excavator shovel 2 remains at the correct angle in the shovel lifting position, such that there is no unwanted emptying of the excavator shovel 2. Part of this parallelogram guide is a coupling rod 23. The coupling rod 23 is connected to the shovel arm connecting lever 9 via a connecting coupling joint with joint axis 23*a*. The coupling rod 23 is connected to the frame component 16 of the excavator structure 15 via an additional shovel arm coupling joint. This function of the parallelogram guide, which includes not only the shovel arm connecting lever 9 but also the other levers of the shovel swivel locking device, can be illustrated by comparing FIGS. 3 and 22, for example.

In the same manner, the shovel arm 3 remains in the shovel arm lifting position, for example, upon the changeover of the excavator shovel 2. If the excavator shovel 2 is shifted from the shovel lifting position to the shovel delivery position with the shovel arm 3 lowered, this leads, depending on the height of the ground on which a lower edge 2*a* of the excavator shovel 2 comes to rest, where applicable to the lifting of the shovel arm 3 from the shovel arm lowering position shown in FIG. 22, for example, into a shovel arm intermediate position, i.e. to a swivel position of the shovel arm 3 between the shovel arm lowering position and the shovel arm lifting position. Such an intermediate position is shown, for example, in FIG. 28.

In the shovel delivery position, the rocker connecting lever 11 is swiveled around the shovel rocker connecting joint 12 by approximately 180° in comparison with the shovel lifting position, for example according to FIG. 4, such that the shovel connecting lever 6 and the rocker connecting lever 11 are now in a relative position stretched out relative to one another and there is a large distance between, on the one hand, the shovel connecting joint 7 and, on the other hand, the shovel arm rocker connecting joint 13. Such large distance between the joints 7, 13 allows the excavator shovel 2 to swivel downwards relative to the shovel arm 3 around the shovel swivel joint 4, as shown in a comparison of FIGS. 3 and 13.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A toy excavator shovel assembly, comprising:

an excavator shovel (2);

a shovel arm (3) to which the excavator shovel (2) is connected via a shovel swivel joint (4); and a shovel swivel locking device (5) for locking the excavator shovel (2) relative to the shovel arm (3), the shovel swivel locking device (5) comprising a shovel connecting lever (6) that is connected to the excavator shovel (2) via a shovel connecting joint (7), a shovel arm connecting lever (9) that is connected to the shovel arm (3) via a shovel arm connecting joint (10), and a rocker connecting lever (11) that is connected, at one end, to the shovel connecting lever (6) via a shovel rocker connecting joint (12) and, at an opposite end, to the shovel arm connecting lever (9) via a shovel arm rocker connecting joint (13), wherein the shovel connecting joint (7), the shovel rocker connecting joint (12), and the shovel arm rocker connecting joint (13) are arranged in such a manner that the rocker connecting lever (11) is displaceable between a shovel lifting position, in which the excavator shovel (2) is in a raised lifting swivel position relative to the shovel arm (3), and a shovel delivery position, in which the excavator shovel (2) lies relative to the shovel arm (3) in a delivery swivel position pivoted downwards in comparison with the shovel lifting position, through a dead center position in which the shovel arm rocker connecting joint (13) passes through a dead center joint plane (14) which is defined by the shovel connecting joint (7) and the shovel rocker connecting joint (12).

2. The excavator shovel assembly according to claim 1, further comprising an operating handle (8) that is fixed to the shovel connecting lever (6).

3. The excavator shovel assembly according to claim 2, wherein the operating handle (8) is configured to exert tensile and compressive forces on the shovel connecting lever (6).

4. An excavator structure (15) for a toy, comprising:

the excavator shovel assembly according to claim 1;

a frame component (16); and an actuating component (18) that is guided in a displaceable manner relative to the shovel arm (3) between a locking position, in which a locking element (19) connected to the frame component (16) interacts with a stop (20) of the shovel arm (3) to hold the shovel arm (3) in a shovel arm lifting position and a release position in which the actuating component (18) displaces the locking element (19) such that it comes out of engagement with the stop (20) of the shovel arm (3), such that the shovel arm (3) is displaceable into a shovel arm lowering position.

5. The excavator structure according to claim 4, wherein the actuating component (18) is pretensioned in the locking position.

6. The excavator structure according to claim 4, wherein the locking element (19) is connected to the frame component (16) via a locking connecting joint (19*a*).

7. A toy with the excavator structure (15) according to claim 4.

8. The excavator shovel assembly according to claim 1, further comprising an operating handle (8) integrally formed in one piece on the shovel connecting lever (6).

* * * * *